US007967296B1

(12) United States Patent
Halverson

(10) Patent No.: US 7,967,296 B1
(45) **Date of Patent: *Jun. 28, 2011**

(54) MODULAR SHOOTING SYSTEM

(75) Inventor: Michael D. Halverson, Las Vegas, NV (US)

(73) Assignee: SRI Aquisition Corp., North Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/686,185

(22) Filed: Mar. 14, 2007

Related U.S. Application Data

(60) Provisional application No. 60/782,109, filed on Mar. 14, 2006.

(51) Int. Cl.
*F41J 11/00* (2009.01)

(52) U.S. Cl. ..... 273/410; 273/404

(58) Field of Classification Search ..... 273/404–410; 52/220.2

See application file for complete search history.

(56) References Cited

U.S. PATENT DOCUMENTS

| | | | |
|---|---|---|---|
| 2,420,304 | A | 5/1944 | Diem |
| 3,398,959 | A | 8/1968 | Sanzare |
| 3,701,532 | A | 10/1972 | Nikoden |
| 3,820,294 | A | 6/1974 | Parker |
| 4,088,322 | A | 5/1978 | Nikoden |
| 4,129,970 | A | 12/1978 | Whitney |
| 4,164,901 | A | 8/1979 | Everett |
| 4,201,385 | A | 5/1980 | Szabados |
| 4,247,115 | A | 1/1981 | Nikoden, Jr. |
| 4,280,307 | A | 7/1981 | Griffin |
| 4,320,606 | A | 3/1982 | GangaRao |
| 4,475,734 | A | 10/1984 | Clarke et al. |
| 4,509,301 | A | 4/1985 | Head |
| 4,598,631 | A | 7/1986 | Everett |
| 4,625,484 | A | 12/1986 | Oboler |
| 4,653,239 | A | 3/1987 | Randa |
| 4,677,798 | A | 7/1987 | Phillips |
| 4,683,688 | A | 8/1987 | Wojcinski |
| 4,731,964 | A | 3/1988 | Phillips |
| 4,759,160 | A | 7/1988 | Fischer |
| 5,088,741 | A | 2/1992 | Simonetti |
| 5,159,791 | A | 11/1992 | Juhas |
| 5,390,466 | A | 2/1995 | Johnson et al. |
| 5,486,008 | A | 1/1996 | Coburn |
| 5,564,712 | A | 10/1996 | Werner |
| 5,618,044 | A | 4/1997 | Bateman |

(Continued)

FOREIGN PATENT DOCUMENTS

DE 3208302 9/1982

(Continued)

OTHER PUBLICATIONS

U.S. Appl. No. 11/687,370, filed Mar. 16, 2007, Halverson.

(Continued)

*Primary Examiner* — Mark S Graham
(74) *Attorney, Agent, or Firm* — Workman Nydegger

(57) ABSTRACT

A shooting system comprising at least one roof panel coupled to at least one wall panel. At least one floor panel is coupled to the at least one wall panel to define a space between the at least one roof panel, the at least one wall panel, and the at least one floor panel. At least one shooting lane and means for collecting projectiles fired along the at least one shooting lane are disposed within the space.

17 Claims, 9 Drawing Sheets

U.S. PATENT DOCUMENTS

| | | | | |
|---|---|---|---|---|
| 5,640,824 | A | 6/1997 | Johnson et al. | |
| 5,718,434 | A | 2/1998 | Alward | |
| 5,724,774 | A | 3/1998 | Rooney | |
| 5,811,718 | A | 9/1998 | Bateman | |
| 5,822,936 | A | 10/1998 | Bateman | |
| 5,846,128 | A | 12/1998 | Kramer | |
| 5,864,992 | A | 2/1999 | Bigelow | |
| 5,893,241 | A | 4/1999 | Schroeder | |
| 5,902,182 | A | 5/1999 | Kramer | |
| 5,916,096 | A | 6/1999 | Wiesmann et al. | |
| 6,085,470 | A | 7/2000 | Bigelow | |
| 6,088,969 | A | 7/2000 | Bigelow | |
| 6,112,473 | A | 9/2000 | Pingel | |
| 6,119,427 | A * | 9/2000 | Wyman et al. | 52/584.1 |
| 6,162,057 | A | 12/2000 | Westphal et al. | |
| 6,305,142 | B1 | 10/2001 | Brisson et al. | |
| 6,349,509 | B1 | 2/2002 | Pingel | |
| 6,415,557 | B1 | 7/2002 | McCalley | |
| 6,438,903 | B1 | 8/2002 | Weiss | |
| 6,457,281 | B1 | 10/2002 | Teron | |
| 6,722,195 | B2 | 4/2004 | Duke | |
| 6,857,218 | B1 | 2/2005 | Grahl et al. | |
| 6,862,847 | B2 | 3/2005 | Bigelow | |
| 6,890,023 | B2 | 5/2005 | Preisler et al. | |
| 6,951,079 | B2 | 10/2005 | Weiss | |
| 7,117,644 | B2 | 10/2006 | Dehart | |
| 7,357,394 | B2 * | 4/2008 | Halverson | 273/410 |
| 2001/0039768 | A1 | 11/2001 | Bigelow | |
| 2002/0083653 | A1 | 7/2002 | Hilbert | |
| 2002/0100235 | A1 | 8/2002 | Weiss | |
| 2002/0108320 | A1 | 8/2002 | Weiss | |
| 2002/0129577 | A1 | 9/2002 | Weiss | |
| 2004/0206015 | A1 | 10/2004 | Greenboim | |
| 2004/0237418 | A1 | 12/2004 | MacBeth | |
| 2004/0237419 | A1 | 12/2004 | MacWatt | |
| 2005/0066590 | A1 | 3/2005 | MacWatt | |
| 2005/0188632 | A1 * | 9/2005 | Rosen | 52/220.2 |
| 2005/0235819 | A1 * | 10/2005 | Long | 89/36.07 |
| 2005/0247024 | A1 | 11/2005 | Bedell et al. | |
| 2005/0257479 | A1 | 11/2005 | Nygren et al. | |
| 2005/0284035 | A1 | 12/2005 | DeOvando et al. | |
| 2006/0080897 | A1 | 4/2006 | O'Neal | |
| 2006/0107985 | A1 | 5/2006 | Sovine | |
| 2006/0185260 | A1 | 8/2006 | Dehart | |
| 2006/0201085 | A1 | 9/2006 | Dehart | |
| 2006/0234069 | A1 | 10/2006 | Sovine et al. | |

FOREIGN PATENT DOCUMENTS

| | | | |
|---|---|---|---|
| GB | 2345069 | | 6/2000 |
| GB | 2391022 | | 1/2004 |
| JP | 3095399 | | 4/1991 |
| JP | 4097033 | | 3/1992 |
| WO | WO 89/11076 | | 11/1989 |
| WO | WO 90/12933 | | 11/1990 |
| WO | WO 93/20299 | | 10/1993 |
| WO | WO 99/02793 | | 1/1999 |
| WO | WO 00/22250 | | 4/2000 |
| WO | WO 01/55517 | | 8/2004 |
| WO | WO 2004/106656 | A1 | 12/2004 |
| WO | WO 2004/106657 | A1 | 12/2004 |
| WO | WO 2006/019391 | A2 | 2/2006 |
| WO | WO 2006/104469 | A1 | 10/2006 |

OTHER PUBLICATIONS

U.S. Appl. No. 11/189,511, filed Jul. 26, 2005, Halverson.
Shooting Solutions Home, information found at www.shootingsolutionsinc.com, Shooting Solutions Home, © 2000 Shooting Solutions, Inc., 1 pg.
Range Consulting—ShootingSolutionsInc.com, information found at www.shootingsolutionsinc.com/range/mobilerange_building.html, © 2000 Shooting Solutions, Inc., 1 pg.
U.S. Appl. No. 11/189,511, Oct. 31, 2005, Office Action.
U.S. Appl. No. 60/615,433, filed Oct. 1, 2004, Halverson.
U.S. Appl. No. 60/692,402, filed Jun. 21, 2005, Halverson.
U.S. Appl. No. 60/782,109, filed Mar. 14, 2006, Halverson.
U.S. Appl. No. 60/782,975, filed Mar. 16, 2006, Halverson.
U.S. Appl. No. 11/189,511, Feb. 7, 2006, Office Action.
U.S. Appl. No. 11/189,511, Jul. 14, 2006, Office Action.
U.S. Appl. No. 11/189,511, Feb. 6, 2007, Office Action.
U.S. Appl. No. 11/189,511, Jun. 8, 2007, Office Action.
U.S. Appl. No. 11/189,511, Sep. 14, 2007, Office Action.
U.S. Appl. No. 11/189,511, Nov. 29, 2007, Notice of Allowance.
U.S. Appl. No. 11/674,307, Jan. 16, 2009, Office Action.
U.S. Appl. No. 12/050,057, Mar. 16, 2009, Office Action.
U.S. Appl. No. 12/050,057, Nov. 3, 2009, Office Action.
U.S. Appl. No. 12/050,057, May 5, 2010, Office Action.
U.S. Appl. No. 11/575,434, Jan. 15, 2009, Office Action.
U.S. Appl. No. 11/687,370, Mar. 19, 2008, Office Action.
U.S. Appl. No. 11/687,370, Oct. 29, 2008, Office Action.
U.S. Appl. No. 12/050,057, Oct. 18, 2010, Notice of Allowance.

* cited by examiner

MODULAR SHOOTING SYSTEM

CROSS-REFERENCE TO RELATED APPLICATIONS

The application claim priority to and the benefit of U.S. Provisional Patent Application No. 60/782,109, filed Mar. 14, 2006 and entitled "Modular Shooting System", the disclosure of which is herein incorporated by reference.

BACKGROUND OF THE INVENTION

1. The Field of the Invention

The present invention generally relates to facilities designed for use with projectiles. More specifically, the present invention relates to modular shooting ranges that can be assembled, disassembled, and transported simply and efficiently.

2. The Relevant Technology

Existing shooting ranges are generally permanent facilities constructed on site. These ranges can be either outdoor or indoor shooting ranges. For outdoor shooting ranges permanent shooting stations, target areas, bullet stops, etc. are constructed on a large plot of land. Although outdoor shooting ranges are designed with safety are a primary consideration, there is, however, the possibility of injury to participants and onlookers within a large surface danger zone. For instance, participants, onlookers, and those unauthorized persons walking in the danger zone can be injured from accidental misfires which may not be directed toward the targets.

Noise also can be a problem with an outdoor shooting range. To alleviate this problem, many outdoor shooting ranges are initially located in a remote area. Unfortunately, the area surrounding the shooting range typically becomes developed for other commercial or for residential purposes. Various steps can be taken to lessen noise somewhat, but the only practical solution to encroachment may be to abandon the shooting range and construct a new range in another area. This can be expensive and time consuming to accomplish due to the significant environmental impact caused be embedded lead within the soil and the resultant clean-up costs associated with a move.

In addition to the above, outdoor ranges are typically only used when the weather permits. In cold climates the limited time during which the range may be used may not justify the cost of the large area required and the expense of construction.

Still another type of mobile shooting ranges uses a modified tractor trailer. Unfortunately, this type of shooting range is not expandable in width or length. In addition, because of the elevated position of the compartment of the trailer, it is difficult to access. Further, it is difficult to install the tractor trailer-type shooting range within a building due to the inclusion of the wheels and the height of the trailer.

To alleviate some of the above problems, another type of shooting range can be used, such as an indoor shooting range. These ranges are typically installed inside a permanent building structure or the like. Again, a disadvantage of such shooting range is that it is stationary. Also the cost of operating such indoor ranges is high because of expense of building the structure or the necessary rental of the premises.

BRIEF SUMMARY OF THE INVENTION

A need therefore exits for a shooting range system that can be inexpensive to operate and eliminates many of the problems associated with existing outdoor and indoor shooting ranges. The present invention generally relates to a shooting range system that is modular in construction to permit expandable capabilities and be moveable to allow for operation at alternative site locations. Advantageously, the modular shooting range system can be pre-engineered to enable simple and efficient movement of the shooting range system as needed. The shooting range system can be built at a location and be operational through simply providing electrical power to the modular shooting range system. The system can be designed with complete ventilation, electrical wiring, optional removable panels, and ballistic rating to prohibit projectile penetration and escape from within the shooting range system.

One aspect is a system that uses individual ballistically rated panels that can be mounted together to create a shooting range having any desired length and number of shooting positions. Advantageously, the modular shooting range system can be easily and efficiently expanded over time to provide flexibility with the types of weapons fired within the shooting range and the number of available shooting positions.

Another aspect is a system that limits the environmental impact caused by use of the modular shooting range system. Advantageously, the modular shooting range system can filter gases and airborne particles produced during firing of a weapon and can collect bullets, shot, and other projectiles for simple disposal. Harmful gases, airborne particles, or used bullets, shot, or projectiles can be collected and prevented from exiting the modular shooting range in an uncontrolled manner.

Still another aspect is a system that can be used for tactical training. Advantageously, one or more wall panels of the modular shooting range system can include one or more removable panels to allow access between adjacent shooting containers. This provides flexibility with the training scenarios used with the modular shooting range system and so provides a system to increase the readiness of those using the modular shooting range system.

Yet another aspect is a system that can be safely transported without damaging the panels forming the shooting range module of the modular shooting range system. With each panel pre-engineered for structural integrity, the modular shooting range system can still be disassembled, transported, and re-assembled without damaging each shooting container.

In one configuration a shooting range module can include a plurality of ballistically rated wall panels coupled to a plurality of floor panels and a plurality of roof panels to define a space. The plurality of ballistically rated wall panels can include at least one ballistic layer to prevent projectiles fired within the space from exiting from the space. The shooting range module can also include at least one shooting lane disposed within the space and means, within the space, for collecting projectiles fired along the at least one shooting lane.

In another configuration, the shooting range module can include a plurality of ballistically rated wall panels locking together to form a plurality of walls of the shooting range module. A plurality of floor panels can be releasably connected to the plurality of wall panels, the plurality of floor panels forming a floor of the shooting range module. A plurality of roof panels can be releasably connected to the plurality of wall panels, the plurality of roof panels forming a roof of the shooting range module. The plurality of walls, the floor and the roof define a space within which fired projectiles are prevented from exiting from the space. The shooting range module can also include at least one shooting lane disposed within the space and means, within the space, for collecting projectiles fired along the at least one shooting lane.

In still another configuration, a method of installing a shooting range system is described. The method can include receiving a plurality of roof panels, a plurality of wall panels, and a plurality of floor panels, each roof panel, wall panel, and floor panel having a ballistic resistance to a projectile having a predetermined velocity. Following receiving the panels, the method can include coupling each wall panel of the plurality of wall panels to one of the plurality of floor panels and each roof panel of the plurality of roof panels to at least two of the plurality of wall panels to define an enclosed space within which a weapon capable of firing the projectile can be fired. At least one support can be prepared to receive at least one of a wall panel of the plurality of wall panels and a floor panel of the plurality of floor panels.

Coupling of the wall panels can include releasably connecting each wall panel the plurality of wall panels to the floor panel of the plurality of floor panels using at least one fastener. Further, adjacently positioned wall panels, adjacently positioned roof panels, and/or adjacently positioned floor panels can be coupled together by positioning a protruding portion of a first panel of the plurality of panels within a receiving portion of a second panel adjacent to the first panel. Alternatively, a first engaging portion of a first panel can interlock with a second engaging portion of a second panel adjacent to the first panel.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIG. 7A illustrates a partial top view of another configuration of a panel usable with one configuration of the shooting range system according to the present invention;

DETAILED DESCRIPTION

Figure 1:
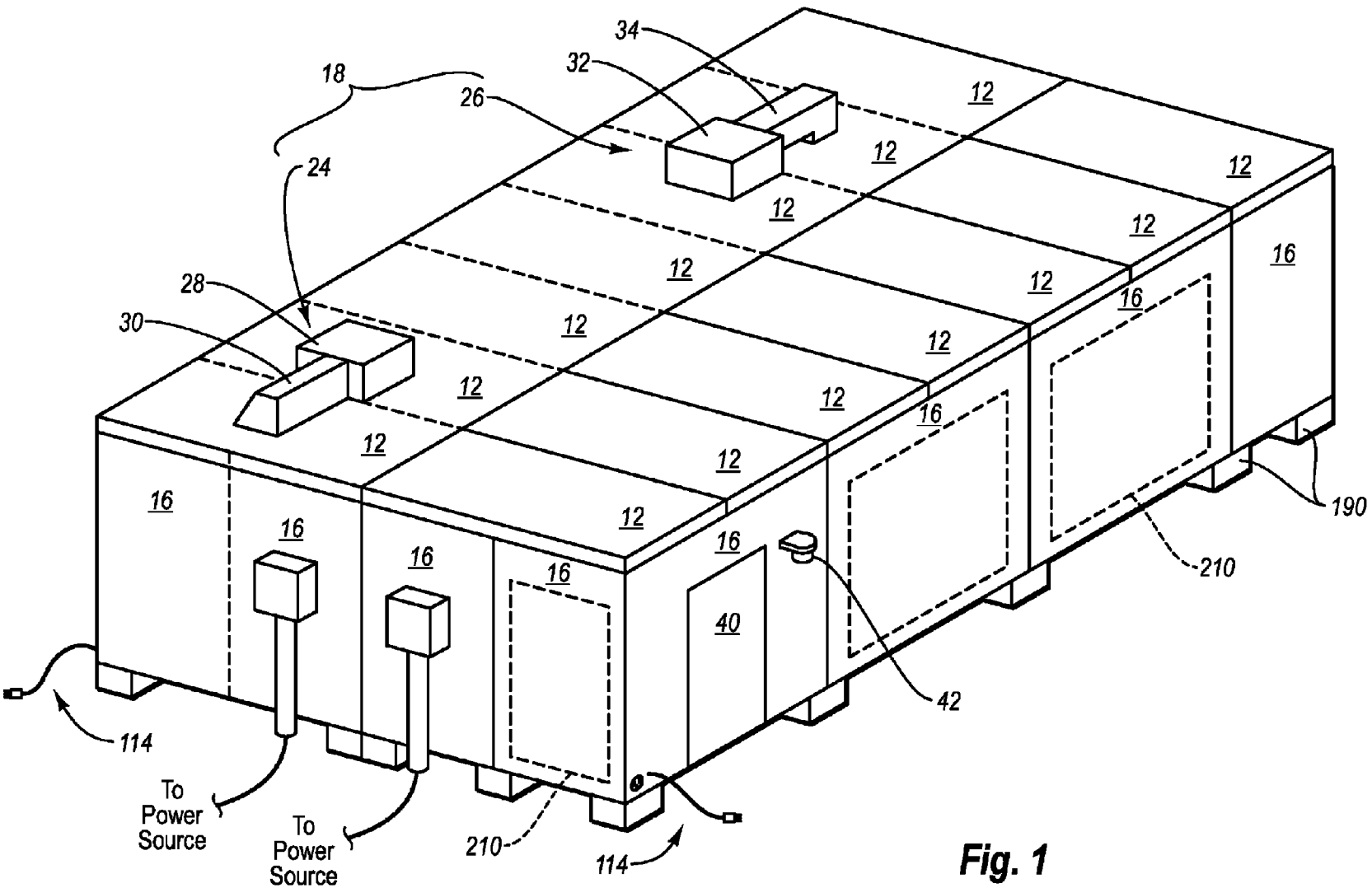
FIG. 1 illustrates a perspective view of a shooting range system according to one configuration of the present invention.

A need therefore exits for a shooting system that can be inexpensive to operate and eliminates many of the problems associated with existing outdoor and indoor shooting ranges. The present invention generally relates to a shooting system that is modular in construction to permit expandable capabilities and be moveable to allow for operation at alternative site locations. Advantageously, the modular shooting system can be pre-engineered to enable simple and efficient movement of the shooting system as needed. The shooting system can be built at a location and be operational through simply providing electrical power to the modular shooting system. The system can be designed with complete ventilation, electrical wiring, optional removable panels, and a structure resistant to penetration by projectiles and inhibit ricochets.

One aspect is a system that uses pre-engineered ballistically rated panels, i.e., panels that are pre-engineered to prevent passage of selected bullets, shots, or projectiles from particular weapons as requested by a customer, that can be mounted together to create an interior space usable as a shooting range having any desired length and number of shooting positions. Advantageously, the panelized modular shooting system can be easily and efficiently expanded over time to provide flexibility with the types of weapons fired within the shooting range and the number of available shooting positions. Further, the interior space can be built out with any particular configuration of shooting lanes, control booths, bullet traps, etc.

Another aspect is a system that limits the environmental impact caused by use of the modular shooting system. Advantageously, the modular shooting system can filter gases and airborne particles produced during firing of a weapon and can collect bullets, shot, and other projectiles for simple disposal. Harmful gases, airborne particles, or used bullets, shot, or projectiles can be collected and prevented from exiting the modular shooting range in an uncontrolled manner.

Still another aspect is a system that can be used for tactical training. Advantageously, the panels used to form the shooting range, or space within which projectiles can move, can include one or more removable sub-panels to allow access between adjacent shooting ranges. Further, the space defined by the panels can be built out as desired to provide various tactical environments in which to practice. This provides flexibility with the training scenarios used with the modular shooting system and so provides a system to increase the readiness of those using the modular shooting system.

Yet another aspect is a system that can be safely transported without damaging the panels usable to form the shooting range. The panels usable to create the shooting range system can be transported via a variety of road, rail, water, and/or air vehicles or transportation mechanisms. Each panel can be releasably connected together to allow for disassembly and transport following installation at an initial location. With each panel being pre-engineered for structural integrity when one or more of the sub-panels are removed the modular shooting system can still be disassembled, transported, and re-assembled without damaging the panels.

In another aspect the system can include one or more panels that can mount together to create one or more shooting lanes from which an individual can fire a weapon. The panels can be pre-wired for electrical components, pre-plumbed for devices requiring water, and/or pre-ducted for heat ventilation and air conditioning ducts or other components. The panels can include pre-finished exteriors so that they are weather proof. In addition, the interior of the panels, and more generally the panels as a whole, can be bullet proof or configured to prevent projectiles fired within the space defined by the panels to exit from the space. Stated another way, the panels used to form the shooting range system are ballistically rated to prevent projectiles escaping from within the interior of the shooting range system. Optionally mountable to one or more of the panels is a ventilation system that filters gases and particulates generated through use of the modular shooting system.

Turning to FIG. 1, illustrated is a perspective view of a shooting range system 8 according to the present invention. As illustrated, shooting range system 8 includes two shooting range module; a first shooting range module 10*a* and a second shooting range module 10*b*. These shooting range modules 10*a* and 10*b* can be disposed upon one or more supports 190 and can be mounted together to create the shooting range system 8 and provide flexibility to indoor training and testing, without the excessive costs and other difficulties with existing indoor training and testing facilities. Although two shooting range modules 10*a* and 10*b* are illustrated, it can be understood by those skilled in the art that the shooting range system 8 can include one or more shooting range modules. The shooting range system 8 of FIG. 1 is illustrated in an expanded width configuration; however, other shooting range module configurations enable the shooting range system to expand to varying widths, lengths, and optionally heights.

The following discussion will be directed to the first shooting range module 10*a*, however a similar discussion may be made for the second shooting range module 10*b*. As such, in the discussion of FIG. 1 we shall use the phrase "shooting range module 10" to refer to either of the first shooting range module 10*a* or the second shooting range module 10*b*.

Figure 2A:
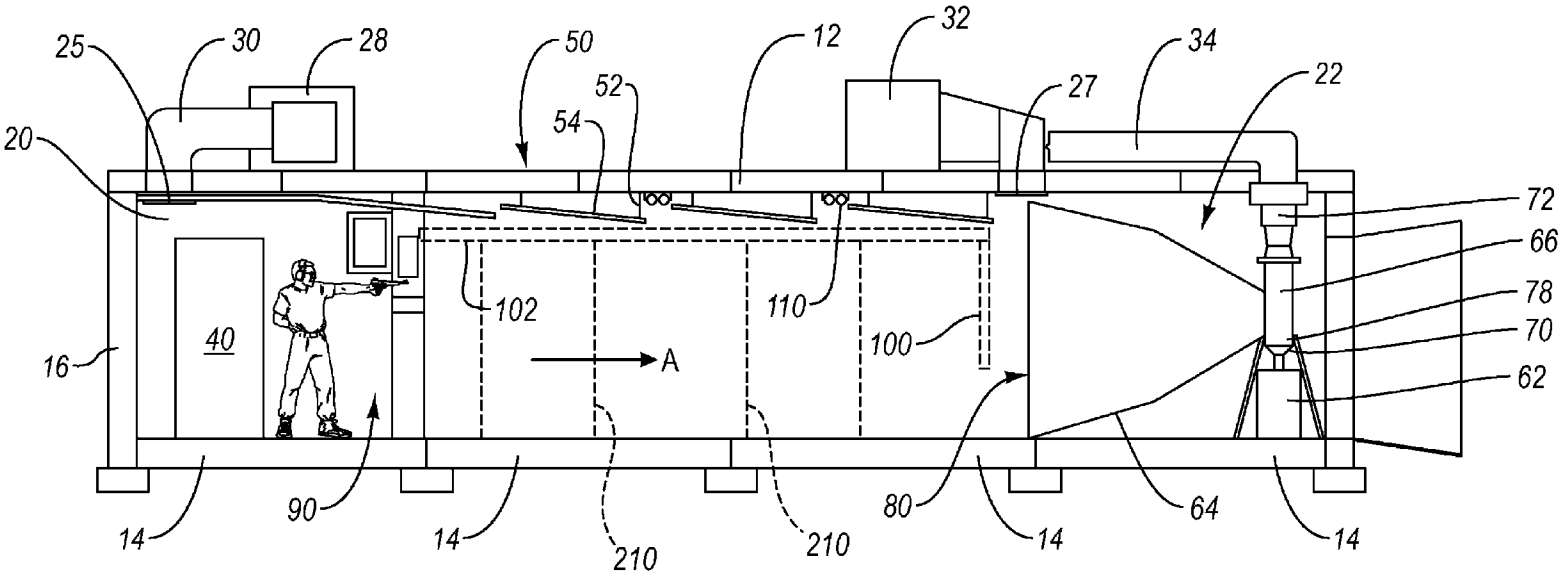
FIGS. 2A and 2B illustrate side views of one configuration of shooting range system according to the present invention.

As illustrated, and with reference to FIGS. 1 and 2A, shooting range module 10 can include at least one roof panel 12, at least one floor panel 14, and at least one wall panel 16. These panels 12, 14, and 16 define an elongated interior space 20. When the at least one, one or more, or plurality of roof panels 12 are coupled together they from a roof of the shooting range module 10. Similarly, when at least one, one or more, or plurality of floor panels 14 are coupled together they form a floor of the shooting range module 10, while when at least one, one or more, or plurality of wall panels 16 are coupled together they form one or more walls of the shooting range module 10.

Mounted to the shooting range module 10 can be a ventilation system 18, such as a heating and air conditioning system. For ease of explanation and to increase clarity of the drawings, the ventilation system 18 is illustrated as being mounted to shooting range module 10*b*. It will be understood, however, that each shooting range module can include a separate and dedicated ventilation system. Alternatively, one ventilation system can be include with the shooting range system 8, with the ventilation system providing the desired heating, cooling, and/or air filtration for the entire shooting range system 8. It is also possible to include one or more back-up ventilation systems that can be brought online in the event that one or more of the ventilations systems fail.

With continued reference to FIGS. 1 and 2A, the ventilation system 18 can include an inlet assembly 24 that directs a flow of air into space 20 through one or more grills or registers 25, while the outlet assembly 26 draws air and other particulates out from within the interior through one or more grills or registers 27. The air delivered to the register 25 can be pressurized so that an air-wall is created behind the shooting positions 60. This provides a laminar air flow of a rate of approximately 50 to 75 feet per minute down range in the direction of arrow A, which meets the U.S. Navy's new 2004 indoor range requirements. This results in no airborne particles or other materials being incident to the shooter at the shooting position.

As illustrated, the inlet assembly 24 can include a heating and air conditioning system 28, optionally with an integral or separate intake fan and ducts 30, which can cool or heat air that is directed to the space 20 by way of an inlet ducts. This air, and any gases and airborne particles generated through use of the shooting range system 8 and the shooting range module 10, can be removed from the space 20 and filtered using a filter system 32 and associated ducts 34 of the outlet assembly 26. With this configuration, the space 20 can be heated, cooled, and the air within ventilated to prevent particles and gases from being incident upon an individual using or outside the shooting range system 8 or shooting range module 10 of the present invention.

The filter system 32 can include a High-Efficiency Particulate Air (HEPA) filter with up to 99.9% HEPA quality air. Air passed through the filter system 32 will be exhausted with no hazardous lead or other airborne contaminant. This provides an environmentally safe shooting range system 8 and provides the desired air quality for the safety of the shooter, instructor, and those outside the shooting range system 8. In one configuration, the filter system 32 can filter the air within the space 20 at 2000 cubic feet per minute.

It will be understood that other filtration systems or techniques and flow rates higher or lower than 2000 cubic feet per minute are possible. For instance, in another configuration, other mechanical air filters, electronic or electrostatic air cleaners, gas-phase adsorption devices, ultraviolet systems, or combinations thereof can be used to clean and/or purify the air removed from the space 20.

With continued reference to FIGS. 1 and 2A, in the illustrated configuration, the shooting range system 8 defines a generally elongated space 20 within which projectiles can move, with the at least one roof panel 12, the at least one floor panel 14, and the at least wall panel 16 being constructed to prevent passage or escape of any projectiles outside the elongated space 20. Stated another way, the at least one roof panel 12, the at least one floor panel 14, and the at least wall panel 16 can be ballistically rated and therefore fabricated from one or more layers or structures that prevent penetration and passage of projectiles, such as, but not limited to rifle rounds up to about .308 and any type of hand-gun rounds, through the at least one roof panel 12, the at least one floor panel 14, and the at least wall panel 16. A customer can select the particular "ballistic rating" for the shooting range system 8, i.e., the particular level of bullet, shot, or projectile resistance of the material forming the shooting range system 8, and each panel 12, 14, and/or 16 can be pre-engineered and pre-fabricated for that particular "ballistic rating" or level of bullet, shot, or projectile resistance. For instance, one or more of panels 12, 14, and/or 16 can be rated from Level 1 through Level 8 and Shotgun of the UL ratings and/or from Level I through Level IV of the National Institute of Justice ratings.

The elongated space 20 can receive other components of the shooting range system 8 or shooting range module 10 to provide mechanisms to enhance the shooting experience. For instance, mounted within the space 20 can be at least one bullet trap system, control booth/consoles, movable targets, etc, as know to those skilled in the art, some of which will be described in more detail hereinafter.

With continued reference to FIGS. 1 and 2A, formed in one of the wall panels 16 is a door 40 to provide access to the space 20. According to the present invention, the door 40 can be a double-swing or single-swing door. Alternatively, the door 40 can take the form of two separate doors that control access to the space 20. For instance, an individual wishing to enter the space 20 may need to open both doors to gain access. This provides additional safety to those entering and exiting the shooting range of the shooting range system 8 provided by the space 20 and also aids with bullet safety and sound attenuation.

Disposed in close proximity to the door 40 can be a "Range in Use" light 42. This light 42 can be illuminated to notify those individuals outside the shooting range system 8 that individuals are shooting or firing weapons within. It can be understood that upon illuminating the light 42, the door 40 can automatically lock to prevent unwanted access to the interior of the shooting range system 8 and limit the possibility of unauthorized access and potential injury. For instance, the door 40 can include an electronic lock, such as a magnetic lock or solenoid bolt, which activates upon illumination of the light 42. When increased security is desirable, in addition to or in place of the above, access to the space 20 of the shooting range module 10 can be controlled through use of security card readers, keypad protection, and/or biometric measures, such as but not limited to, fingerprint scans, retinal scans, iris scans, voice print identification measures, combination thereof, or the like.

With continued reference to FIG. 2A, the space 20 can receive numerous mechanisms to enhance the shooting experience and provide safety to those using the shooting range system 8. As illustrated, one or more of the roof panels 12 can be pre-engineered with structures that aid with directing bullets, shots, or projectiles toward at least one bullet trap assembly 22, that receives and collects the bullets, shots, or projectiles. These structures can include a plurality of deflector assemblies 50. Each deflector assembly 50 can, optionally, be mounted to a roof panel 12 during the initial manufacture of the shooting range system 8 at a location distant from the final location of the shooting range system 8. Prefabricating the roof panel 12 with the deflector assembly 50 produces quality and workmanship uniformity because roof panel 12 and deflector assembly 50 fabrication occurs in a controlled environment, rather than at the final installation location of the shooting range system 8. Uniformity of quality and workmanship generates installation efficiencies, thereby reducing the install times.

The deflector assembly 50 can include a support structure 52 usable to mount a deflector structure 54, such as a deflector plate or other structure, to the roof panel 12 in an inclined fashion. With the incline of the deflector structure 54 being generally inclined in the direction that bullets, shot, or projectiles traverse toward the at least one bullet trap assembly 22, i.e., direction indicated by arrow A, deflector structure 54 directs bullets, shot, or projectiles hitting the deflector structure 54 towards the at least one bullet trap assembly 22.

Generally, support structure 52 can be any structure that can support and aid with mounting the deflector structure 54 to the roof panel 12, such as, but not limited, to brackets, mechanical fasteners, adhesives, welds, or other device(s) and/or techniques for mounting one structure to another structure. Optionally, length and/or orientation of each support structure 52 can be varied to vary the angular orientation of the deflector structures 54 relative to each other and to the roof panel 12. The angular orientation of each deflector structure 54 can be about thirty degrees, however, it will be understood that angular orientations larger and smaller than thirty degrees are possible so long as the deflector structures 54 direct any bullet, shot, or projectile down range toward the means for collecting the bullets, shots, or projectiles.

The deflector structure 54 can be fabricated from a steel plate, such as 9 gauge steel to ⅜ AR 500. In one configuration, the deflector structure 54 has a sandwich configuration with one or more layers of material, such as but not limited to metals, metal alloys, fiber board, safety wood, sound proofing material, controlling material, or noise absorbing material or barriers, synthetic materials, natural materials, combinations thereof, or other materials that one skilled in the art could identify. For instance, each deflector structure 54 can be at least partially covered with acoustical foam or material sold under the trademark SONEX or any other sound proofing or controlling material or noise absorbing material or barriers. It will be understood that in other configurations the deflector structure 54 can be fabricated from one or more of the above-mentioned materials, so that the deflector structure 54 is fabricated from one or more layers.

Optionally, one or more of the panels 14, and/or 16 can also include various structures to help direct the bullets, shots, and projectiles to the at least one bullet trap assembly 22. This at least one bullet trap assembly 22 can be considered one structure capable of performing the function of a means for collecting the bullets, shots, or projectiles. Various other configurations of such a means are known to those skilled in the art.

In one configuration, the at least one bullet trap assembly 22 includes one or more bullet traps 60 accessible through doors 38 formed in the walls 16 formed at one or both ends of the shooting range system 8. Each bullet trap assembly 22 changes the forward inertia and velocity of the bullet, shot, or projectile into rotational motion that allows gravity to force the bullet, shot, or projectile to drop into a removable collecting canister 62.

The bullet trap 60 can include a funnel-shaped inlet 64 that receives and guides the bullet, shot, or projectile to a collection chamber 66. As a bullet, shot, or projectile enters the collection chamber 66, helical structures (not shown) within the collection chamber 66 change the forward velocity to rotational motion that decelerates the bullet, shot, or projectile until it falls to a lower portion 68 of the collection chamber 86 and exits into the collecting canister 62 through a funnel 70 or other structure capable of directing the bullet, shot, or projectile from one structure to another structure. When the collecting canister 62 is full, it can be replaced with an empty collecting canister.

Mounted to an upper portion 72 of the collection chamber 66 is the duct 34. As the bullet, shot, or projectile traverses the collection chamber 66 any generated airborne particles, dust, or gases can be removed from the collection chamber 66 by the ventilation system 18. This eliminates any airborne particles and gases that can be hazardous to an individual operating or using the shooting range system of the present invention.

With the configuration described above, the lead associated with the bullets, shots, or projectiles can be safely collected and subsequently disposed with the minimum of effort and without hazard to the operator of the shooting range system. This complies with regulations for the training of both military and law enforcement personnel and preventing contamination of soil, air and water near the shooting range system 8.

Figure 3:
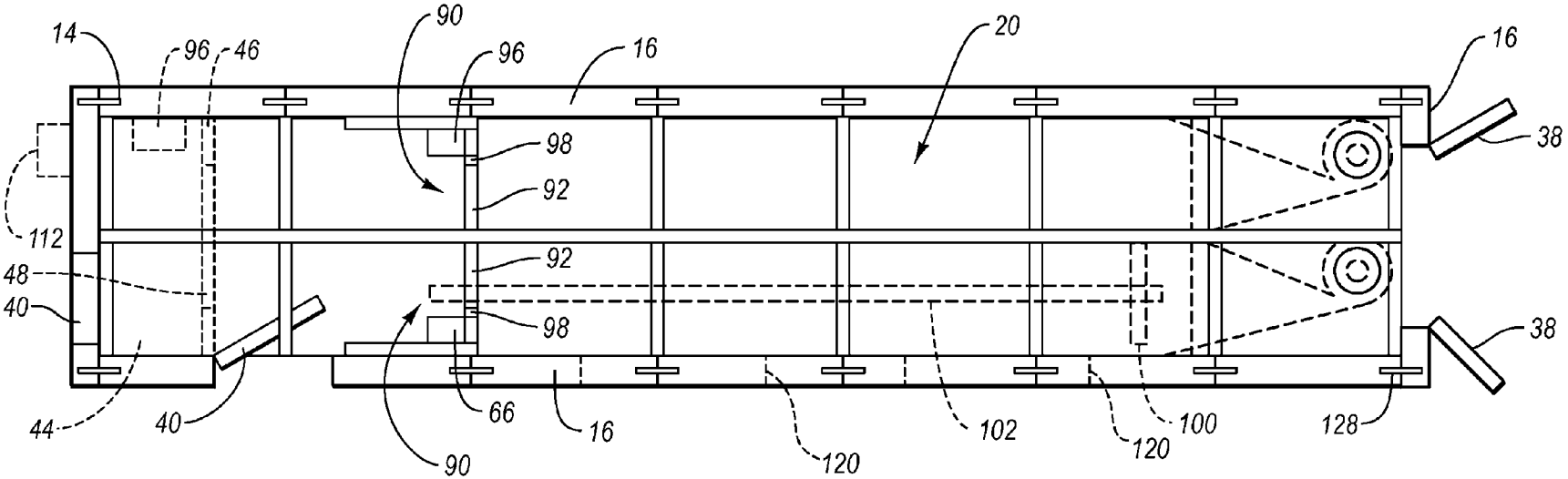
FIG. 3 illustrates a top view of one configuration of shooting range system according to the present invention

Turning to FIGS. 2A and 3, illustrated is an exemplary interior of the shooting range module 10 of the present invention. The interior of the shooting range module 10 is generally split into three portions; a first portion 80 from which an individual can fire a weapon, a second portion 82 through which a bullet, shot, or projectile is fired, and a third portion 84 having means for collecting the bullet, shot, or projectile. The first portion 80 can include two firing positions 90 from which an individual can fire a weapon. This results in the shooting range module 10 having two shooting lanes. It will be understood that the shooting range module 10 can include a greater or lesser number of firing positions 90 and so number of shooting lanes.

As illustrated in FIGS. 2A and 3, each firing position 90 can include an overturning or removable support 92 used to support the weapons fired from the shooting position 90. Separating the two shooting positions 90 can be a dividing wall 94, with optionally walls mounted to adjacently disposed wall panels 16 of shooting range module 10. The dividing wall 94 can be made from bullet-proof and/or anti-rebound material and can also optionally be made of sound-absorbing material. For instance, in one configuration, the dividing wall 94 and the other walls forming part of the shooting station 90 can be manufactured to a level 3 bullet resistant level.

Optionally located at each shooting station 90 are (i) a monitor 96 to view one or more targets 100 located in close proximity to the end of the second portion 82, and (ii) a controller 98 to control the lighting, air temperature, air pressure, filter usage, and position of the one or more target 100. For instance, the controller 98 can operate an electronic target retrieval system 102, such as a movable track, suspended from the roof panels 12 of the shooting range module 10 to move the one or more targets 100 and to vary the position of the one or more targets 100 for distance adjustment in live fire training. This eliminates the need for the shooter to travel down range for target shooting. Only one target 100 and one electronic target retrieval system 102 are depicted in FIGS. 2A and 3; however, those skilled in the art will appreciate that various other numbers of electronic target retrieval systems and targets can be used.

It can be understood that the first portion 80 can include a separate monitor 96 and controller 98 operable by an instructor or operator of the shooting range system 8. In this manner, the instructor or operator, rather than and optionally in addition to those individuals firing from the shooting positions 90, can control and monitor the lighting, air temperature, air pressure, filter usage, and position of the one or more target 70.

In addition to the above, each shooting position 90, and optionally the first portion 80, can include a noise suppression mat upon which the shooter can stand while firing his/her weapon. This mat can both suppress noise and provide comfort to the shooter. In one configuration, the mat can be a rubber mat. More generally, any material that can provide the desired comfort to the shooter and noise reduction or suppression can be used.

With continued reference to FIGS. 2A and 3, optionally mounted within the space 20 are one or more lights 110. Lights 110 provide illumination to a shooter located within the space 20. These lights 110 can be of various types, such as florescent, halogen, or any other type of device to illuminate at least a portion of the space 20 for at least a period of time. Optionally, the lights 110 can have the form of a strobe light such that shooting practice and training may be performed in the dark with a strobe light operating. This provides a different environment for the shooter to practice and be tested.

Returning to FIG. 1, to provide electrical power to the shooting range system 8 and the devices or structures requiring electricity, the panels 12, 14, and/or 16 can be pre-wired and optionally include a main outside panel 112, one or more interior electrical panels (not shown), with associated electrical disconnects and breakers. By providing electricity to the single main outside panel 112, electricity is provided to the entire shooting range system 8. Alternatively, each shooting range module 10 can include a dedicated main outside panel 112, thereby allowing each shooting range module 10 to be independently powered and optionally independently operated. Whether the shooting range system 8 includes one or more main outside panels 112, it is possible to operate each shooting range module 10 independently to reduce the costs with operating the shooting range system 8. In particular, an instructor or operator of the shooting range system 8 can provide electrical power to only one shooting range module 10, such as shooting range module 10*a*, while maintaining the other shooting range modules of the shooting range system 8 in a non-powered or deactivated status. This reduces to operating costs for the shooting range system 8.

To facilitate electrical connectivity, one or more of the panels 12, 14, and/or 16 can include electrical connectors so that adjacently mounted panels 12, 14, and/or 16 can electrically connect 114, schematically illustrated in FIG. 1, to enable electricity to flow from panel to panel and/or module to module. Various types of electrical connectors are know to those skilled in the art, including but not limited to, electrical plugs and sockets.

Following will be a general discussion regarding the various panels 12, 14, and 16 usable to form the shooting range system 8 and the associated shooting range modules 10. Varying the number of panels 12, 14, and 14 used to form the shooting range system 8 can vary its length and width. In this manner, the number of lanes per shooting range module 10 and the number of shooting range modules 10 per shooting range system 8 can be varied. Further, variations in the length and width of each first portion 80, second portion 82, and third portion 84 are achievable to adjust the functionality and operability of the shooting range system 8. For instance, a shooting range system 8 usable with handguns can be shorter in length than one for use with rifles or assault weapons. With the panels 12, 14, and 16 releasably connecting together, or connected or coupled together in a manner that can allow disconnection or decoupling of the panels 12, 14, and 16 the shooting range system 8 is modular and transportable while maintaining the desired structural integrity. Further, the flexibility afforded through use of the panels 12, 14, and 16 allows an operator of the shooting range system 8 to increase or decrease the length of the shooting range system 8, and its associated modules 10, by simply adding or removing the desired number of panels 12, 14, and 16. In addition, it is possible to completely disassembly the shooting range system 8, transport the panels 12, 14, and 16 to another location, and reassembly. Thus, the shooting range system of the present is in fact portable and modular.

As shown, the space 20 within the shooting range module 10 can be defined by one or more floor panels 14. These floor panels 14 can abut, overlap, or interlock with one another in at least one direction, and preferably in at least two directions. By so doing, the floor panels 14 are retained in place by at least one, and preferably at least two other panels, providing additional structural integrity to the shooting range system 8.

Figure 4A:
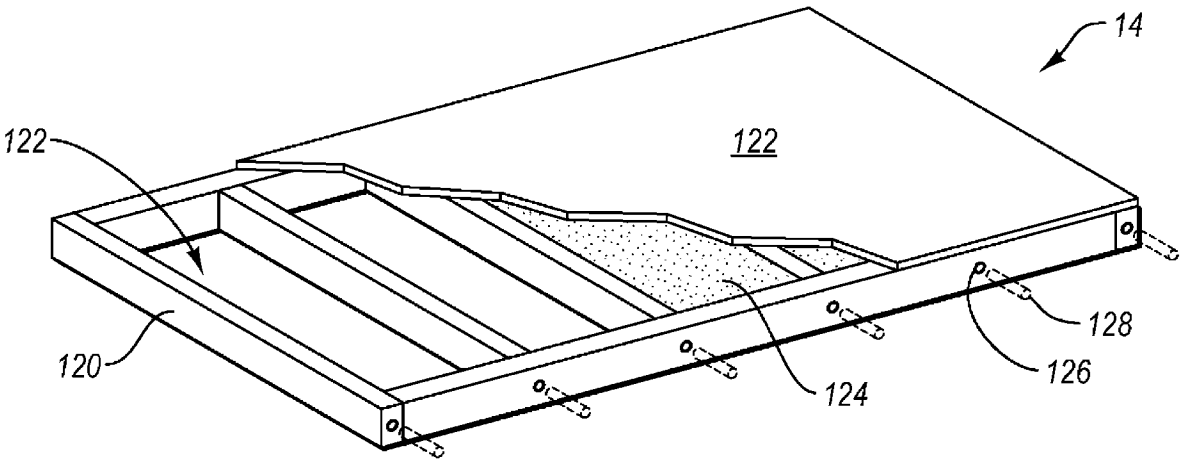
FIG. 4A illustrates a partial cut-away perspective view of one panel usable with one configuration of the shooting range system according to the present invention.

Turning to FIG. 4A, illustrated is a representation of one configuration of the floor panel 14. This illustrated floor panel 14 can be disposed against adjacently positioned floor panels 14 in an abutting type relationship, i.e., edges or peripheral surfaces of the floor panel 14 abut or are in close proximity with adjacently positioned floor panels. Floor panel 14 provides the structural support for an individual using the shooting range system 8. As illustrated, floor panel 14 has a generally planar configuration with a plurality of connected support members 120 that provide structural rigidity to the floor panel 114. These support members 120 can be made from wood, metal, metal alloys, synthetic materials, natural materials, or other materials that can provide the desired structural rigidity.

Mounted to an upper surface, and optionally a lower surface, of this connected support members 120 is a ballistic panel 122. Instead of two ballistic panels 122, a lower supporting and non-ballistic panel can be used. In either case, disposed between the two panels is a sound proofing or controlling material or noise absorbing material or barriers 124. Optionally, the material or barrier 124 used to provide the noise reduction can also provide thermal insulation. When this is not the case, an insulation material or insulator can be provided within the space between the two ballistic panels 122 or the ballistic panel 122 and non-ballistic panel.

To aid with mounting of the floor panels 14, support members 120 include one or more receiving holes 126. Although receiving holes 126 are shown in only one of the support members 120, it will be understood that one or more of the support members 120 can include the receiving holes 126. Fasteners 128 can be located within receiving holes 126 of adjacently positioned floor panels 14 and securely held in place with an appropriated retainer. For instance, a fastener 128 in the form of a threaded member can be disposed through receiving holes 126 and a nut threaded upon the threaded member to maintain the threaded member 128 in place. Other types of fastener may be used to maintain the position of adjacently positioned floor panels 14. For instance, and not by way of limitation to any other type of fastener or member that can be used to maintain the position of adjacently positioned floor panels 14, a friction or interference fit fastener can be disposed in the receiving holes of adjacently positioned floor panels such that the interference fit with the fastener prevents movement of the floor panels.

Figure 4B:
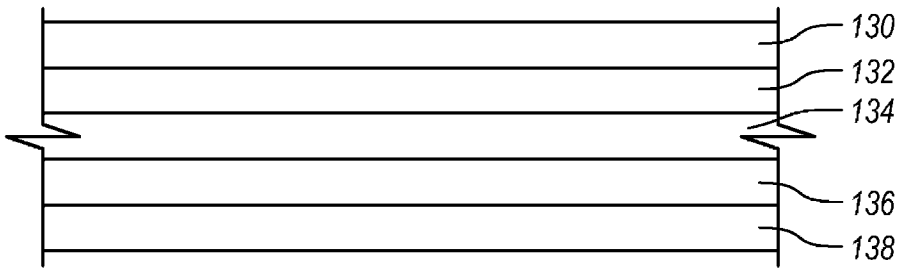
FIG. 4B illustrates a side cross-sectional view of a portion of the panel of FIG. 4A of one configuration of the shooting range system according to the present invention.

The ballistic panel 122 provides bullet, shot, or projectile resistance. As shown in FIG. 4B, ballistic panel 122 in one configuration has a layered construction that can (i) prevent bullets, shot, and projectiles from exiting the space 20 and (ii) reduce the noise heard by individuals outside the space 20. When a ballistic panel 122 is disposed on a lower surface of support members 122, it may optionally include a finished exterior coating per customer requests. It will be understood, however, that ballistic panel 122 can have a single layer that prevents bullets, shot, and projectiles from exiting the space 20, while the space defined by the support members 120 can be filled or otherwise used to reduce the noise heard by individuals outside the space 20.

As shown in FIG. 4B, a layered ballistic panel 122 can included a first layer 130 upon which individuals may walk. Optionally, this first layer 130 may (i) cushion the individual, (ii) be sufficiently textured to prevent an individual slipping, and/or (iii) be liquid impervious. Synthetic or natural materials may be used, but metals or metal alloys having the desired texture may also be used.

To provide structural support or additional structural support, the first layer 130 can be disposed upon a structural panel support 132. In contact with the structural panel support 132 can be a bullet, shot, or projectile resistant layer 136. The structural panel support 132 and the bullet, shot, or projectile resistant layer 134, these layers can be made from metallic plates or panels. The structural panel support 132 can be fabricated from a material, such as steel, that is bullet, shot, or projectile proof to a 9 mm bullet at point blank fire. Similarly, the bullet, shot, or projectile resistant layer 134 can be fabricated from a material, such as steel, that is bullet, shot, or projectile proof to 7.62 by 39 rifle bullet at point blank fire. In another configuration, the bullet, shot, or projectile resistant layer 134 can be fabricated from a material, such as steel, that is bullet, shot, or projectile proof to .308 rifle bullet at point blank fire. More powerful calibers can be accommodated by varying the number of layers and armor resistant material used. In one configuration, the bullet, shot, or projectile resistant layer 134 can be 9 gauge up to ⅜ inch plate steel with an optional smooth finish. More generally, the bullet, shot, or projectile resistant layer 134 can be made from a material with a Brinell rating based upon the type of weapon being used. For instance, the bullet, shot, or projectile resistant layer 134 can having a Brinell rating of 400 or 500 depending upon the particular pistol or rifle being used within the shooting range module 10. The particular bullet, shot, or projectile resistant layer 134 can have sufficient structural integrity to resist penetration by bullets, shots, or projectiles and optionally inhibit rebounding bullets, shots, or projectiles while serving as a guiding mechanism to keep bullets, shots, or projectiles traveling down range toward the bullet stop assembly 22 (FIG. 1).

In some circumstance, the structural panel support 132 can also be fabricated from wood, fiber board, metal, metal alloy, synthetic material, natural material, combinations thereof or the like.

Optionally disposed between the resistant layer 134 and an optional second bullet, shot, or projectile resistant layer 138 can be an insulation layer or a sound proofing or controlling or noise absorbing or reducing layer 136. The insulation layer 136 can be made from any material or combinations of materials that function to insulate or to prevent the passage or heat, electricity, or sound through the surface(s) to which the material is mounted. In one configuration, the insulation can be, for instance, and not by way of limitation, fiberglass, rockwool, cellulose, polystyrene, polyurethane, polyisocyanurate, vermiculite, perlite, or other types of insulating material.

It will be understood that the order of the layers described herein can be varied based upon the particular configuration of the floor panel 14. In addition, other layers can be included in the layered construction of the floor panel 14. For instance, one or more extra bullet, shot, or projectile resistant layer, insulation layer, structural panel support layer, noise reduction layer, or the like can be added. In addition, one or more layers can be excluded from the ballistic panel. For instance, the structural panel support layer need not be included if the reminder of the layers, whether alone or in combination with the support members 120 and other panels, provide structural support to floor panel 14 sufficient to support individuals using the shooting range system 8 (FIG. 1) and/or the mechanisms and devices deployed within the shooting range system 8. Further, a rubber protection layer can be added to the above described layers to aid with reducing in ricochets. Optionally, the first layer 130 can have ricochet reduction characteristics or properties.

Figure 5A:
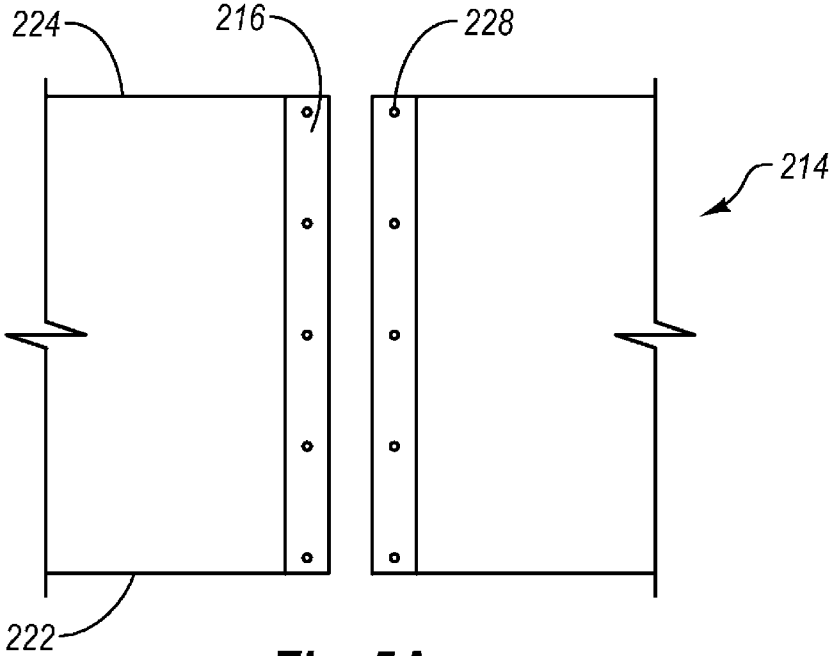
FIG. 5A illustrates a partial top view of another configuration of a panel usable with one configuration of the shooting range system according to the present invention.
Figure 5B:
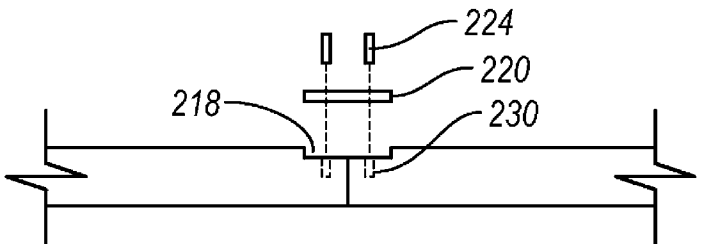
FIG. 5B illustrates a partial side view of the panel of FIG. 5B according to one configuration of the shooting range system according to the present invention.

Turning to FIGS. 5A and 5B, illustrated is another configuration of a floor panel according to the present invention. Floor panel 214 has a similar configuration to that of floor panel 14, and as such the discussion related to floor panel 14 also applies to floor panel 214. Rather than the generally planar configuration of floor panel 14, floor panel 214 includes a stepped portion 216. When floor panels 214 are positioned in close proximity to one another, the stepped portions 216 of the two floor panels 214 form a channel 218 that can receive a securing member 220. In the illustrated configuration, the stepped portion 216, the channel 218, and the securing member 220 extend from a first side 222 to a second side 224 of the floor panel 214. In other embodiments, however, the stepped portion 216, the channel 218, and the securing member 220 extend partially from the first side 222 toward the second side 224.

With the elongate securing member 220 mounted within the channel 218, fasteners 226 can be disposed within holes 228 in the stepped portion 216 and into complementary holes 230 in floor panel 214. The adjacently positioned floor panels 214 are then mounted together.

It will be understood by those skilled in the art that the elongate securing member 220 and the fasteners 224 can have various configurations and be fabricated from various materials. In one configuration, the fastener 226 can be threaded to threadably engage with a threaded portion of either or both of holes 228 and 230, can friction fit with either or both of holes 228 and 230, or can engage with either or both of the holes 228 and 230 in some other manner known to those skilled in the art. Further, although the stepped portion 216 and the securing member 220 are illustrated along only certain sides of the floor panel 214, it will be understood by those skilled in the art that one or more of the sides, and generally any portion of the floor panel 214, can include the stepped portion 216 and couple with the securing member 220.

In one configuration, either or both of the securing member 220 and the fastener 224 are fabricated from a metal, metal alloy, plastic, synthetic material, natural material, or combinations thereof. It will also be understood that the securing member 220 can be mounted within the channel 218 without the use of a fastener 224. Rather, securing member 220 mounts within channel 218 through an interference fit, adhesives, chemical bonding, or combinations of the same, whether or not the preceding are used along or in combination with a fastener.

Figure 6A:
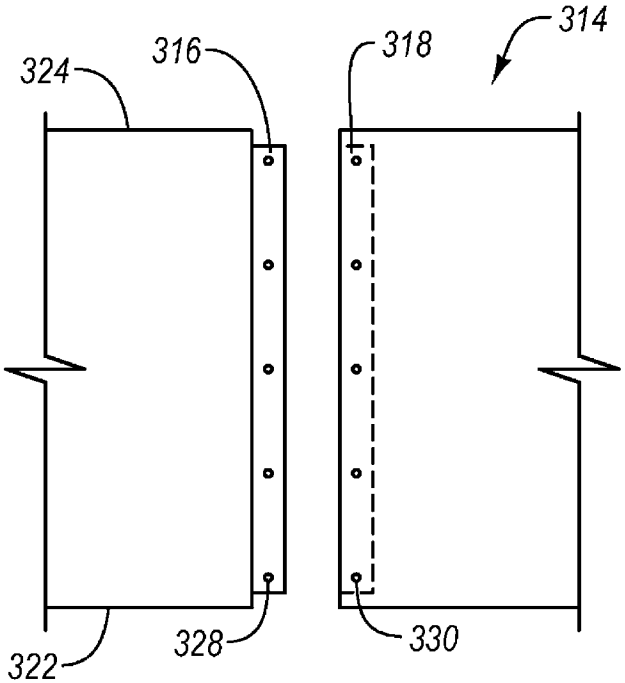
FIG. 6A illustrates a partial top view of yet another configuration of a panel usable with one configuration of the shooting range system according to the present invention.
Figure 6B:
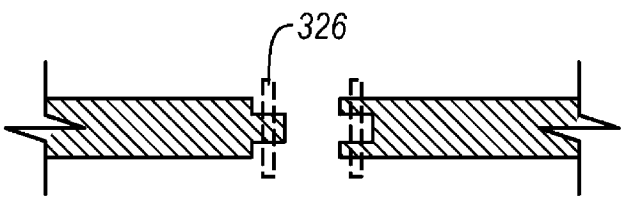
FIG. 6B illustrates a partial side view of the panel of FIG. 6B according to one configuration of the shooting range system according to the present invention.

Turning to FIGS. 6A and 6B, illustrated is another configuration of a floor panel according to the present invention. Floor panel 314 has a similar configuration to that of floor panel 14 and 214, and as such the discussion related to floor panel 14 and 214 also apply to floor panel 314.

As illustrated, each floor panel 314 can include a protruding portion 316 and a receiving portion 318 that is complementary to and can receive the protruding portion 316 of an adjacently positioned floor panel 314. The protruding portion 316 extends partially from a first side 322 toward a second side 324 of the floor panel 314. Although both the protruding portion 316 and the receiving portion 318 are illustrated as extending partially from the first side 322 toward the second side 324, in other configurations the portions 316 and 318 extend from the first side 322 to the second side 324. Further, although the protruding portion 316 and the receiving portion 318 are illustrated along only certain sides of the floor panel 314, it will be understood by those skilled in the art that one or more of the sides, and generally any portion of the floor panel 314, can include the protruding portion 316 and the receiving portion 318.

The complementary nature of protruding portion 316 and the receiving portion 318 alleviates the need to use fasteners to connect adjacently positioned floor panels 314. However, it is possible to utilize one or more fasteners 326 through corresponding holes 328 and 330 to aid with retaining the protruding portion 316 within the receiving portion 318. The fastener 326 can be threaded to threadably engage with a threaded portion of either or both of holes 328 and 330, can friction fit with either or both of holes 328 and 330, or can engage with either or both of the holes 328 and 330 in some other manner known to those skilled in the art.

Figure 7A:
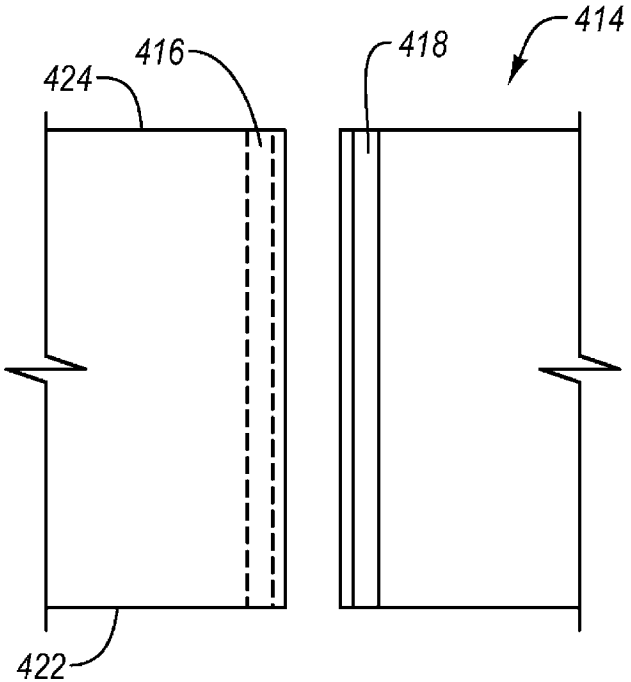
FIG. 7A illustrates a partial top view of still another configuration of a panel usable with one configuration of the shooting range system according to the present invention.
Figure 7B:
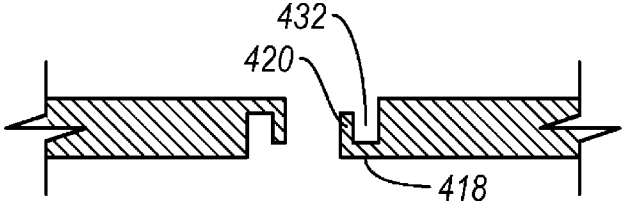
FIG. 7B illustrates a partial side view of the panel of FIG. 7B according to one configuration of the shooting range system according to the present invention.

Turning to FIGS. 7A and 7B, illustrated is another configuration of a floor panel according to the present invention. Floor panel 414 has a similar configuration to that of floor panel 14, 214 and 314, and as such the discussion related to floor panel 14, 214, and 314 also apply to floor panel 414.

As illustrated, each floor panel 414 can include an engaging portion 416, the engaging portion 416 of adjacently positioned floor panels 414 being orientated 180 degrees relative to each other. In this manner, two engaging portions 416 lock together to prevent movement of adjacently positioned floor panels. The engaging portion 416 includes an extension 418, a leg 420 extending from the extension 418, and a channel 432 defined by the extension 418 and the leg 420. Adjacently positioned floor panels 414 lock together as the leg 420 of one engaging portion 416 is received within the channel 432 of the other engaging portion 416, and vice versa.

Although both the engaging portion 416 is illustrated as extending partially from a first side 422 toward a second side 424, in other configurations the engaging portion 416 can extend from the first side 422 to the second side 424. Further, although the engaging portion 416 are illustrated along certain sides of the floor panel 314, it will be understood by those skilled in the art that one or more of the sides, and generally any portion of the floor panel 414, can include the engaging portion 416.

The complementary nature of engaging portion 416 alleviates the need to use fasteners to connect adjacently positioned floor panels 414. However, it is possible to utilize one or more fasteners or other techniques or structures described herein or otherwise known to one skilled in the art.

Although reference is made to the above-described manners for connecting adjacently positioned floor panels 14, there are various other techniques or manners that can be used. For instance, in another configuration, a portion of one floor panel 14 can overlap and selectively or releasably mount to a portion of an adjacent floor panel 14. The overlapping portions can be bolted together or otherwise attached to prevent unwanted movement between adjacently positioned floor panels 14. Instead of, or in combination with, the above, the floor panels 14 can be connected together through welding, mechanical fasteners, complementary engagement structures, such as, but not limited, to threads, interference fits, etc., or other techniques or structures for mounting one structure to another structure. Generally, the floor panels 14 can be connected together either directly or by way of an intermediate structure or material.

In addition to the above, although reference is made to the above-described manners for connecting adjacently positioned floor panels 14, it will be understood that the same or similar manners and structures can be used to couple (i) two wall panels, (ii) two roof panels, (iii) a roof panel and a wall panel, (iv) a wall panel and a roof panel, or (v) any other combination of one or more roof panels, wall panels, floor panels, or other structures of the shooting range system.

Returning to FIGS. 1 and 2A, as described previously, the panels 12, 14, and/or 16, whether alone or in combination with the deflector assembly 50 and bullet trap assembly 22 prevent bullets, shot, and projectiles from exiting the space 20. To facilitate this functionality, the wall panels 16 can have a similar configuration to that of the floor panels 14 described previously; the description of the floor panels 14 also applying to the description of the wall panels 16. The wall panels 16, therefore, can have a layered construction that can (i) prevent bullets, shot, and projectiles from exiting the space 20, (ii) reduce the noise heard by individuals outside the space 20, and (iii) provide a finished exterior coating per customer requests.

Figure 8:
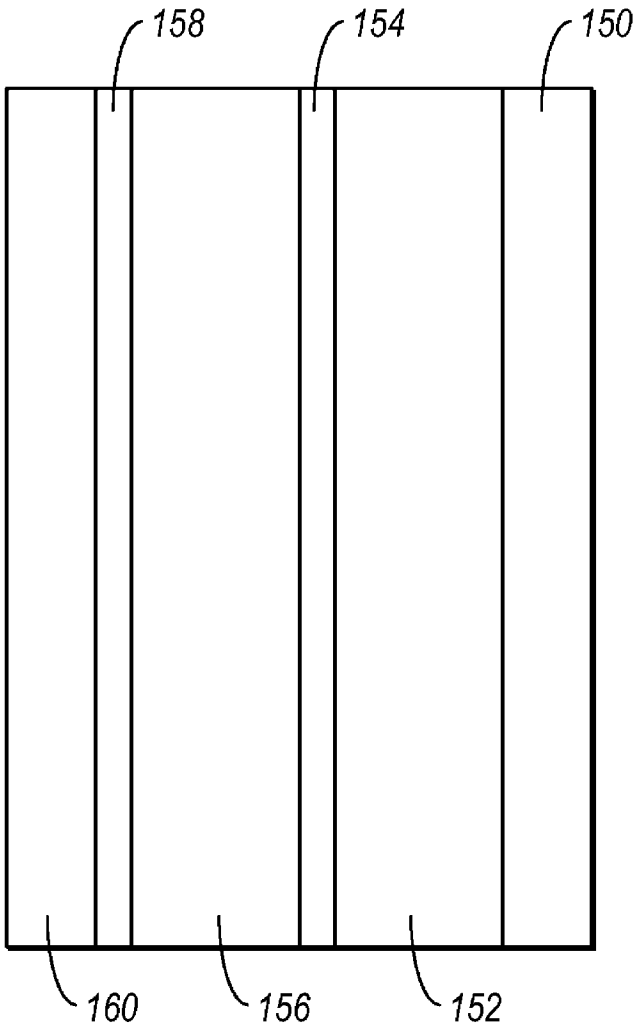
FIG. 8 illustrates a partial cross-sectional side view of a wall panel usable with one configuration of the shooting range system according to the present invention.

To achieve the above, and with reference to FIG. 8, each wall panel 14 can include an exterior finish layer 150 disposed on an insulation layer 152, which is in turn disposed on a structural panel support 154. Another insulation layer 156 can be disposed on the structural panel support 154, with a bullet, shot, or projectile resistant layer 138 disposed on the insulation layer 156 and an optional sound proofing or controlling or noise absorbing or reducing layer 160, such as the layer associated with the deflector structure 54 (FIG. 2A), disposed on the bullet, shot, or projectile resistant layer or panel 158. It will be understood that the order of the layers described herein can be varied based upon the particular configuration of the wall panel 14. In addition, other layers can be included in the layered construction of the wall panel 14. For instance, an extra bullet, shot, or projectile resistant layer can be disposed between the insulation layer 156 and the structural panel support 154. Similarly, a second structural panel support, with associated insulation, can be disposed between the structural panel support 154 and the insulation 152. Further, the optional sound proofing or controlling or noise absorbing or reducing layer 160 can optionally be substituted with a rubber protection layer that can aid with reducing in ricochets.

Generally, the exterior finish layer 150 can be made from any material selected by a customer of the shooting range system 8 (FIG. 1). For instance, the exterior finish layer 150 can be a polymer siding, such as those provided under the trademark KYNAR. In other configurations, any polymeric or metallic products usable to cover the insulation 152 and prevent wind, water, and other weather elements contacting the insulation 152.

Turning to the insulation layers 152 and 156, these can be made from any material or combinations of materials that function to insulate or to prevent the passage or heat, electricity, or sound through the surface(s) to which the material is mounted. In one configuration, the insulation can be, for instance, and not by way of limitation, fiberglass, rockwool, cellulose, polystyrene, polyurethane, polyisocyanurate, vermiculite, perlite, or other types of insulating material.

With respect to the structural panel support 154 and the bullet, shot, or projectile resistant layer 158, these layers can be made from metallic plates or panels. The structural panel support 154 can be fabricated from a material, such as steel, that is bullet, shot, or projectile proof to a 9 mm bullet at point blank fire. Similarly, the bullet, shot, or projectile resistant layer 158 can be fabricated from a material, such as steel, that is bullet, shot, or projectile proof to 7.62 by 39 rifle bullet at point blank fire. In another configuration, the bullet, shot, or projectile resistant layer 134 can be fabricated from a material, such as steel, that is bullet, shot, or projectile proof to .308 rifle bullet at point blank fire. More powerful calibers can be accommodated by varying the number of layers and armor resistant material used. In one configuration, the bullet, shot, or projectile resistant layer 158 can be 9 gauge up to ⅜ inch plate steel with an optional smooth finish. More generally, the bullet, shot, or projectile resistant layer 158 can be made from a material with a Brinell rating based upon the type of weapon being used. For instance, the bullet, shot, or projectile resistant layer 158 can having a Brinell rating of 400 or 500 depending upon the particular pistol or rifle being used within the shooting range module 10. The particular bullet, shot, or projectile resistant layer 158 can have sufficient structural integrity to resist penetration by bullets, shots, or projectiles and optionally inhibit rebounding bullets, shots, or projectiles while serving as a guiding mechanism to keep bullets, shots, or projectiles traveling down range toward the bullet stop assembly 22 (FIG. 2A).

Figure 9C:
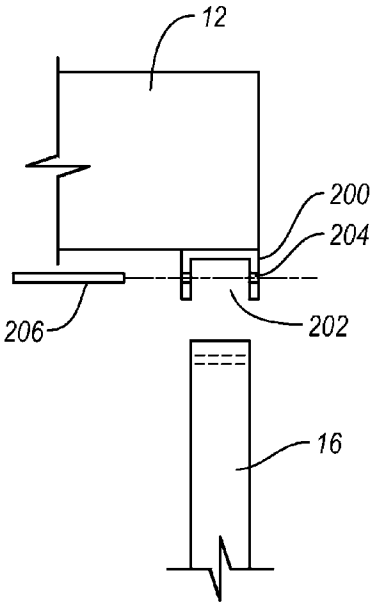
FIG. 9C illustrates another side view of a portion of roof panel and a wall panel usable with one configuration of the shooting range system according to the present invention.
Figure 9A:
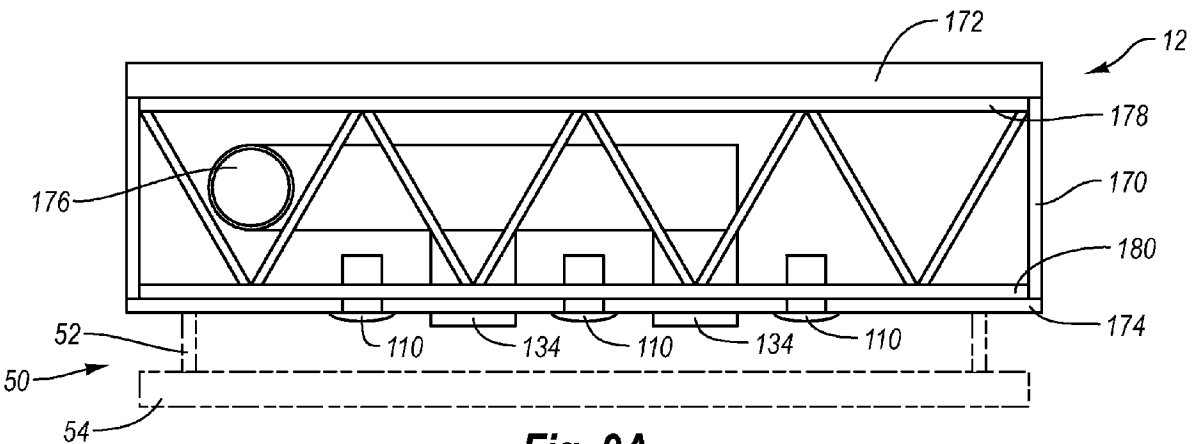
FIG. 9A illustrates a side view of a roof panel usable with one configuration of the shooting range system according to the present invention.
Figure 9B:
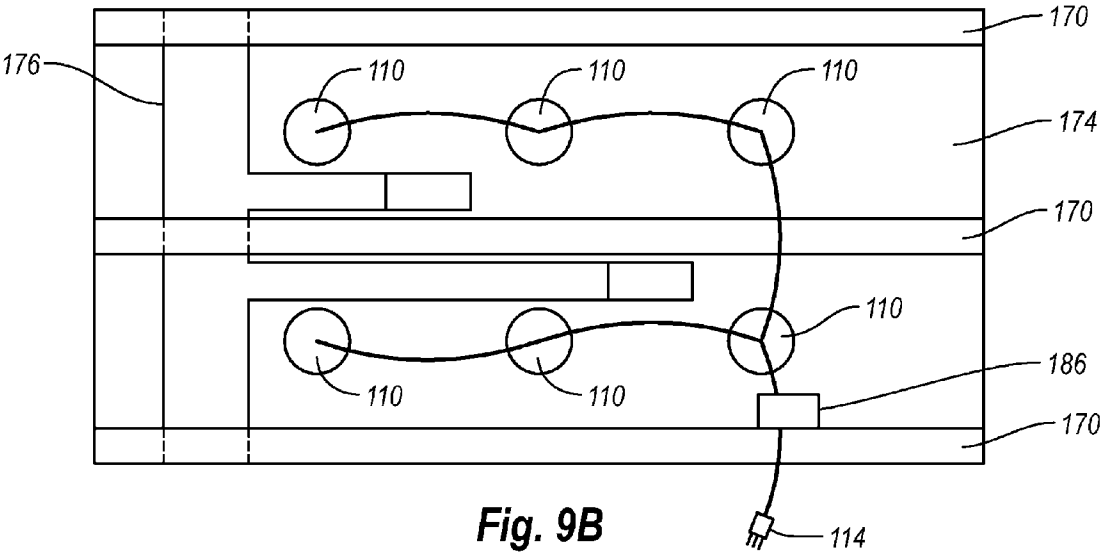
FIG. 9B illustrates a top view of the roof panel of FIG. 9B according to one configuration of the shooting range system according to the present invention.

Turning now to FIGS. 9A and 9B, illustrated is one configuration of a roof panel 12. The roof panel 12 has sufficient structural integrity to extend from adjacently positioned wall panels 14 to aid with enclosing the space 20 (FIG. 2A). To provide some or all of the structural integrity, roof panel 12 includes one or more roof support members 170, such as a beam, truss, girder, or other member. These roof support members 170 can be made from wood, metal, metal alloys, synthetic materials, natural materials, or other materials that can provide the desired structural rigidity.

In addition to providing structural support to the roof panel 12, the roof support members 170 or other support members that extend perpendicularly between one or more support members 170 support or provide an anchor point for (i) the deflector assembly 50, and its associated support structure 52 and deflector structure 54, (ii) the lights 110, and/or (iii) one or more interior ducts 182 and associated grills or registers 25 and 27 that directs air flow into or from the space 20 (FIG. 1).

Mounted to an upper portion 178 of the roof support members 170 is a roof member 172, while mounted to a lower portion 180 of the roof support members 170 is a ceiling member 174. Each of the roof member 172 and the ceiling member 174 can have a configuration similar to ballistic panel 122. In addition, the roof member 172 can optionally include an exterior finish layer similar to the exterior finish layer 150 of the wall panel 14 to create a water proof roof to the shooting range module 10 (FIG. 1).

Disposed within the space defined between the upper portion 178 and the lower portion 180 can be interior ducts 182 that carry air drawn into and directed from the space 20 (FIG. 1) by the ventilation system 18 (FIG. 1). The interior ducts 182 can form part of the ventilation system 18. With the roof panel 12 being pre-engineered with the interior ducts 182, time and costs are saved during installation of the shooting range module 10 (FIG. 1). When the roof of the shooting range module 10 is complete, i.e., the roof panels 12 are mounted together, the interior ducts 182 are connected together without significant installation on-site.

Similar, lights 110 can be pre-installed within the roof panel 14, including being pre-wired. Using a breaker box 186 or other electrical connector, adjacently positioned roof panels 12 can be electrically connected together. This again saves time and costs during installation of the shooting range module 10 (FIG. 1).

Now that information has been provided regarding the panels 12, 14, and 16, and certain manners by which the panels 12, 14, and 16 can be connected or otherwise positioned to engage one with another to form the shooting range module 10 and shooting range system 8, it is understood that there are various other manners that are possible.

Figure 2B:
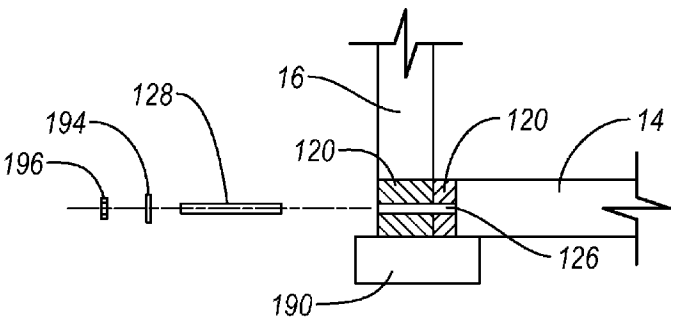

Turning firstly to FIG. 2B, one illustrative manner by which a floor panel 14 and wall panel 16 can be mounted together. As shown, the floor panel 14 and wall panel 16 can rest upon a pre-formed footing 190. Alternatively, the floor panels 14 can rest upon a previously pour concrete pad or the ground.

As shown, a support member 120 or end of the floor panels 14 abuts to a support member or end of the wall panel 16. A fastener 128, such as a bolt or other threaded member, can pass through a support member 120 of the wall panel 16 and engage with a complementary hole 126 within the floor panel 14. For instance, the fastener 128 can threadably engage with a threaded hole 126, or a hole with a threaded member disposed within the hole 126, in the floor panel 14. A nut 196, and optional spacer/washer 194, securely anchors the wall panel 16 to the floor panel 14. Optionally, the wall panel 16 can be welded to the floor panel 14, either instead of or in combination with use of the fastener.

It will be understood that there are various other manners of connecting the wall panel 16 to the floor panel 14. For instance, the wall panel 16 can rest upon the floor panel 14 or can abut and rest upon the floor panel 14. Further, and similar to the configuration described with respect to FIGS. 6A and 6B, the wall panel 16 can include a protruding portion that engages with a receiving portion formed in an upper surface of the floor panel 14, or vice versa. More generally, the floor panel 14 and the wall panel 16 can be connected together through welding, mechanical fasteners, complementary engagement structures, such as, but not limited, to threads, interference fits, etc., or other techniques or structures for mounting one structure to another structure. Generally, one skilled in the art can identify various other manners for connecting the floor panels 14 to the wall panels 16.

To connect adjacent floor panels 14, an overlap connection 152 can be used. For instance, a portion of one floor panel 14 can overlap and selectively or releasably mount to a portion of an adjacent floor panel 14. The overlapping portions can be bolted together or otherwise attached to prevent unwanted movement between adjacently positioned floor panels 14. Instead of, or in combination with, bolting the two floor panels 14 together other fasteners or techniques for connecting two members together can be used. For instance, the two floor panels 14 can be connected together through welding, mechanical fasteners, complementary engagement structures, such as, but not limited, to threads, interference fits, etc., or other techniques or structures for mounting one structure to another structure. Generally, the floor panels 14 can be connected together either directly or by way of an intermediate structure or material In another configuration, adjacently positioned floor panels 14 can be connected through the mating of a protrusion in one floor panel 14 and a receiving recess in the adjacently positioned floor panel 14. The protrusion can extend along the length or width of the floor panel 14 or have a discrete length that is shorter than the length of width of the floor panel 14. It will be understood by one skilled in the art that the receiving recess can have various configurations so long as it is complementary to the protrusion. Generally, one skilled in the art can identify various other manners for connecting adjacent floor panels 14 in light of the teaching contained herein.

Turning now to FIG. 9C, illustrated is one configuration by which the roof panel 12 mounts to the wall panel 16. As shown, mounted or otherwise coupled to the roof panel 12 is a generally C-shaped bracket 200 having a receiving recess 202 and fastener receiving holes 204. The recess 202 is configured to receive a portion of the wall panel 16, while the fastener receiving hole 204 is configured to receive a fastener 206, similar to the other fasteners described herein, which passes through the bracket 200 and through a hole 126 in the support member 120 of the wall panel 16. The fastener 205 can threadably engage with the hole 126 or can pass through the hole 126 and secured through use of a nut 196 and spacer/washer 194 in a similar manner to that described with respect to FIG. 2B.

Although reference is made to this particular configuration for mounting the wall panel 16 to the roof panel 12, it will be understood that the roof panel 12 can be mounted to the wall panel 16 using any of the techniques or structures used to mount the wall panel 16 to the floor panel 14 or to mount two floor panels 14.

Returning to FIGS. 1 and 2A, in some instances, the shooting range system 8 can be used to create one or more independent spaces. For example, a user may desire a first space for a first range of projectile calibers, and a second space for a second range of projectile calibers. This can be achieved by simply dividing the space 20 into two by mounting the wall panels 14 within the space 20. Alternatively, a second space can be formed by mounting additional panels 12, 14, or 16 to those panels 12, 14, or 16 that define a first space, whether or not such second space is located beside or above the first space. In either case, it can be beneficial to provide access between the adjacent spaces so that the user of the shooting range system 8 can have flexibility as to the user's particular use. For instance, the user may wish to use the two spaces for tactical training and so wish to allow students or participants to move from one space to another.

To provide the desired flexibility, one or more of the panels 12, 14, or 16 can optionally be engineered with one or more removable sub-panels 210 to enable access between adjacently positioned spaces 20. With these one or more removable sub-panels 210, the shooting range system 8 is also expandable in width to accommodate various number of firing lanes and allows for expansion of the shooting range system 8 (FIG. 1) to accommodate any number of adjacently positioned shooting range modules.

These one or more removable sub-panels 210 can be removed to provide an access opening between adjacently positioned shooting range modules. With accessing openings having various widths positioned at any location along the length of the shooting range module, the shooting range module can be used for tactical training. Once a removable sub-panel 210 is removed, the resultant opening can be filled with a door or other structure or unfilled to allow unimpeded access to an adjacently positioned shooting range module. The shooting range system 8, therefore, can be used not only as a lane-type shooting range but as a true fire training facility that simulates urban warfare, building clearing, tactical assaults, and other training exercises.

The area of the panels 12, 14, or 16 around the sub-panels 210 can pre-engineered and constructed to prevent damage to the panels 12, 14, or 16 during transporting, assembling, and disassembling. This is unlike any other portable range. Other indoor shooting ranges are assembled and then cutouts and accesses are created on site, making the structure unsound to move. With the panels 12, 14, or 16 pre-engineered for assembly, disassembly, and transporting as many times as needed, the shooting range module 10 remains structurally safe to move and use.

Various manners are provided to enable the sub-panels 210 to be removable. For instance, the sub-panels 210 can be bolted onto a particular panel 12, 14, or 16 and removed as needed. In other configurations, the panels can be welded onto a particular panel 12, 14, or 16 and removed as needed.

In some circumstances, an operator of a shooting range module or system may desire to change its configuration. As described before, the length and width can be adjusted by merely adding roof panels 12, floor panels 14, and wall panels 16. To adjust the height of the shooting module it is possible to use an extension portion 510 that mounts to an end of the wall panel 16.

Figure 10B:
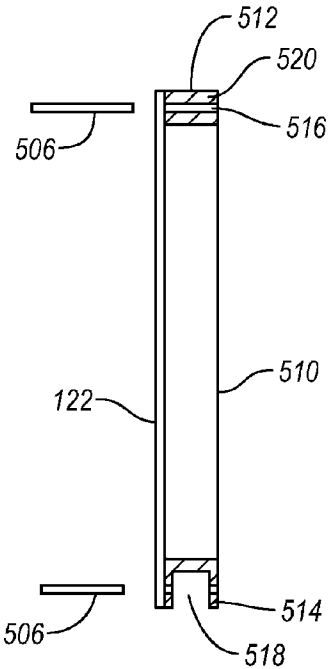
FIG. 10B illustrates a side view of an extension portion usable with the shooting range system according to the present invention.
Figure 10A:
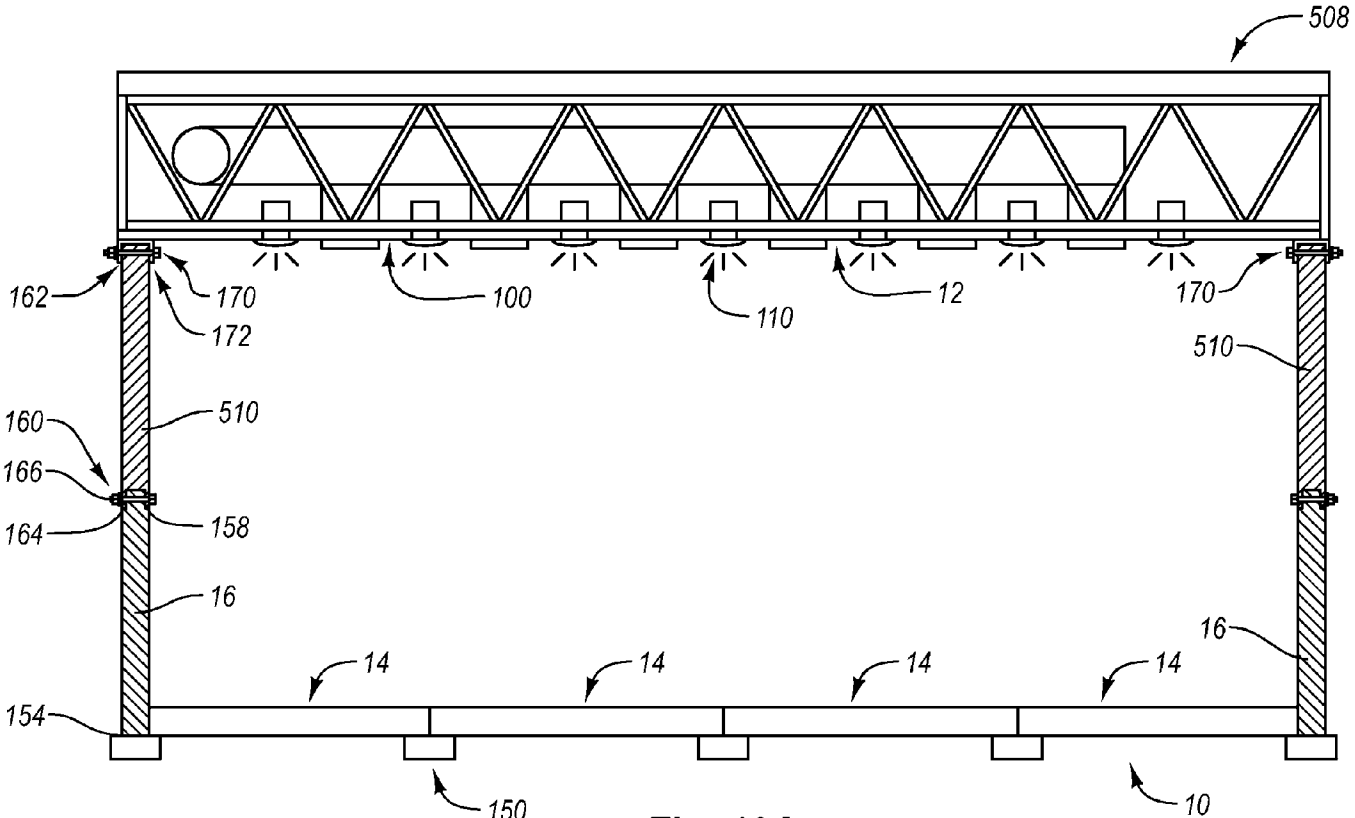
FIG. 10A illustrates a side view of another configuration of a shooting range system according to the present invention.

Turning now to FIG. 10, illustrated is another configuration of a shooting range system utilizing the extension portion 510. The features, functions, and structures associated with shooting range system 8 (FIG. 1) are also applicable to the shooting range system 508. As such, like structures, features, and functions will be identified with like reference numerals.

The extension portion 510 has a first end 512 and a second end 514. As with the roof panels 12, floor panels 14, and wall panels 16, the extension portion 510 can include the ballistic panel 122 to prevent passage of bullets, shots, or projectiles. The first end 512 is configured to be received within the bracket 200 and receive the fastener 206 through the hole 126 in a support member 520, which is similar to support member 120 and/or roof support member 170. To aid with this, a hole 516 can be formed at first end 512. It will be understood that if the first end is adapted to engage or couple with the roof panel 12 through a different mechanism or techniques, the configuration of the first end can be changed accordingly.

Disposed at the second end 514 is a channel 518 that can receive and end of the wall panel 16. The wall panel 16 can be optionally retained in the channel 518 by way of a fastener 506. It will be understood that the second end 514 can have various other configurations and the extension portion 510 can be coupled to the wall panel 16 by way of a number of other techniques and structures. For instance, a C-shaped, U-shaped, H-shaped, or other bracket can be used to couple the extension portion 510 to the wall panel 16.

Further, instead of, or in combination with, using fastener 506 or brackets to mount the wall panel 16 with the extension portion 510 other fasteners or techniques for connecting two members together can be used. For instance, the wall panel 16 and the extension portion 510 can be welded together. More generally, the wall panel 16 and the extension portion 510 can be connected together through welding, mechanical fasteners, complementary engagement structures, such as, but not limited, to threads, interference fits, etc., or other techniques or structures for mounting one structure to another structure.

Generally, the shooting range system 8 can provide various benefits that are not available to existing shooting ranges. For instance, the shooting range system 8 is scalable and expandable so that additional space and shooting lanes can be added as needed through purchase and installation of additional panels 12, 14, or 16. The panels 12, 14, or 16 can be fabricated from a metal, metal alloy, or other material sufficient to provide the desired strength and rigidity and provide some resistance to bullets, shot, or projectiles fired within an interior thereof. The panels 12, 14, or 16 can mount together to create one or more shooting lanes (side by side or above and below) and an area to perform tactical training, optionally with stairs for access to multi-level spaces. For instance, a customer can select the width and length, and optionally height, of the shooting system and the desired number of panels 12, 14, or 16, and associated bullet trap assemblies and air handling assemblies, can be brought to customer site in sections via a flatbed trailer and set in place using cranes, forklift vehicles, etc. These panels 12, 14, or 16 are pre-engineered to enable disassembly, transportation, and reassembly as many times as needed without damaging the structural integrity of the shooting system. Stated another way, the panels 12, 14, or 16 can be releasably connected to allow for assembly and disassembly as desired. This is in contrast to existing indoor systems that are modified on-site and reduce the structure integrity to allow numerous disassemblies, transportations, and reassemblies.

With this modular configuration, the length of the shooting system and associated space can be varied from forty feet to greater than one hundred feet. It will be understood that the particular length of the shooting system can be selected based upon the particular the customer's desired configuration. It will be also understood that that particular length of the shooting system can be greater or lesser than one hundred feet and/or forty feet. The width and height of the shooting system can also be varied as needed.

Returning to FIG. 3, as mentioned above, the space 20 can be built out in accordance with the needs of a particular customer. As such, it is possible to include interior walls having a similar configuration to the wall panels 16 to create at least one control booth 44 from which the operation of the shooting range system 8 can be controlled. This control booth 44 can be pre-engineered with a requested shooting range system 8 or can be added at a later date. The control booth 44 can be used to control components of shooting range system 8 and/or monitor a person or targets within the shooting area. For instance, the control booth 44 can control ventilation, electrical system, lighting, monitors, computer operations, etc.

Optionally, a portion of the control booth 44 can include a divider wall 46 from behind which participants, onlookers, or others can be positioned outside the danger zone, while also allowing them to move around and monitor any of the various shooting lanes. In addition, the divider wall 46 can create a separation between the control booth 44 and the shooting area that aids with sound attenuation. When shooting range system 8 (FIG. 1) includes a divider wall 46, one or more doors 40 may also be provided to allow access to the control booth 44 either through the space 20 of from the exterior of the shooting range system 8.

Optionally, one or more windows (not shown) can be formed in divider wall 46. These windows allow a person within the control booth 44 to view the shooting area, including any people or targets therein. The combination of divider wall 46 and the windows can further allow safe monitoring and/or control of shooting area. Optionally, the divider wall 46 can be fabricated from bullet-proof, anti-rebound, and/or sound-absorbing materials. For instance, the divider wall 46 may be made from a steel plate, or may have one more layers of metal, fiber board, safety wood, or other materials. In some configurations, the divider wall 46 can be formed from the same or different materials as other portions of the shooting range system 8. Additionally, windows can be fabricated from a substantially transparent, bullet-proof and/or anti-rebound material such as bullet-proof glass. In this manner, control booth 44 can be protected from stray bullets or projectiles which may it against the divider wall 46.

The divider wall 46 can also isolate the control booth 44 from the environment within the shooting area. In some configurations, the ventilation system 18 (FIG. 1) provides heating and/or air conditioning to shooting area. Where control booth 44 is isolated from shooting area, control booth 44 can have a separate ventilation system including heating and/or air conditioning components to reduce the risk that contaminants and airborne particles from shooting area will enter control booth 44.

Optionally, ventilation system 18 (FIG. 1) can provide ventilation to shooting area through use of an air-wall 48. In one configuration, the air-wall 48 can be fabricated from a sheet of material which contains a series of holes or perforations through which air from the ventilation system 18 (FIG. 1) passes to create a laminar flow in shooting area in the direction which the users will fire the projectiles. In one configuration, the air delivered through the air-wall 48 can be pressurized to provide a laminar air flow of a rate of approximately 50 to 75 feet per minute down range in the direction of arrow A, which meets the U.S. Navy's new 2004 indoor range requirements. This results in no airborne particles or other materials being incident to the shooter at the shooting position. It will be understood that other flow rates are also possible.

The sheet of material can be substantially transparent, thus allowing a person inside the control booth 44 to view the shooting area through the windows and the air-wall 48. Representative transparent materials usable in the air-wall 48 can include, but are not limited to, polycarbonate (e.g. Lexan) and polyacrylic (e.g. Lucite).

It can be appreciated by a person having ordinary skill in the art that the air-wall 48 can be separate from the divider wall. In other configurations, the divider wall 46 can be perforated or include a series of holes, thereby optionally eliminating the need for a separate air wall 48. In addition, in some configurations, the windows are not formed in the divider wall 46. Further, a transparent air-wall 46 may form substantially the entire divider wall 46 and windows, such that separate windows can be omitted without eliminating the visual view of the shooting lanes from control booth 44. Alternatively, either in place of, or in addition to the windows, a video surveillance system may be used to monitor the space 20. In such an implementation, the control booth 44 can include one or more display monitors (not shown) which receive a video feed from one or more cameras (not shown) which monitor the shooting lanes.

Generally, the shooting system of the present invention is fully capable of modular expansion as shooting range demand increases and is completely self-contained only requiring power source and location from the customer. The shooting system is also transportable in sections to reassemble at alternative locations, includes means for abating noise to satisfy statutory noise emission specifications, and includes a ventilation system that is designed to ventilate across entire range removing harmful vapors, fumes, and airborne particulate matter safely during range operation.

As can be understood from the above, the shooting range system and individual shooting range modules can be install using a variety of techniques. The panels and other components, mechanisms, and structures of the shooting range system can be transported from a manufacturing facility where the panels are pre-engineered in accordance with the above. For instance, the panels can be pre-engineered according to the desired ballistic rating so that the panels are resistant to bullets, shots, or projectiles of a predetermined velocity in line with the selected ballistic rating or level of resistance. Further, panels can be pre-engineered based upon desired noise suppression/abatement levels and desired insulation aspects. In addition, ducts used with the ventilation system and electrical or control cabling associated with the shooting range module can be pre-engineered to reduce the time and cost for installation.

Once the panels and other components, mechanisms, and structures of the shooting range system are prepared, they can be delivered to and received at the installation location. Transport of the panels and other components, mechanisms, and structures can be achieved via road, rail, air, or water transportation.

During pre-engineering, transportation, or upon receipt of the panels and other components, mechanisms, and structures, footings, support pads, or other support structures can be prepared. These will form the support structure upon which shooting range modules can be mounted.

When all panels and other components, mechanisms, and structures have been received it is possible to begin the installation process. As such, floor panels can be positioned upon the footings, support pads, or other support structures and releasably or fixably connected together. For instance, floor panels can be placed in abutting relationship. In another configuration, a protruding portion of a first floor panel can be received within a receiving portion of a second floor panel adjacent to the first floor panel. In still another configuration, an engaging portion of one floor panel can lockingly engage with an adjacently positioned floor panel. In still another configuration, floor panels can be welded, connected using one or more fasteners or securing members, and/or otherwise fixably connected together.

Following or during floor installation, the wall panels can be releasably connected or fixably connected together and to the floor panels to form the wall of the shooting range module or system. The installation can be similar to floor panel installation to reduce the difficulty and equipment used to form the shooting range module or system.

During or following either floor or wall installation, roof panels can be releaseably or fixably connected to the wall panels to define an enclosed space within which a weapon capable of firing the projectile can be fired. As with the wall panel installation, roof panels can be releasably or fixably connected using the techniques and structures described above. In addition, interior ducts pre-engineered in the roof panels can be connected to form the interior ducting of a ventilation system; some of the components of the ventilation system optionally being mounted to the roof formed by the roof panels. Similarly, electrical connections can be made when the roof panels, floor panels, and/or wall panels are linked together.

Once the space is defined by the panels, the other portions of the shooting range module can be mounted within. For example, the ventilation system can be mounted to the shooting range module, the bullet traps can be disposed therein, the firing positions formed, the target retrieval system installed, etc.

It will be understood that the particular order by which the installation can be performed can vary based upon the particular installation. As such, the description of the installation process should not be considered as limiting other orders for preparing or installing the shooting range system of the present invention.

By achieving the above, the present invention can function as a modular shooting range for Military and Law Enforcement training and test firing use. The modular characteristics of the shooting system enable a customer to purchase and use the system as needed based upon location and budgetary constraints. For instance, a customer may need a total of ten firing positions, but can only afford to purchase two positions. The present invention enables the used to continue to purchase and add panels until their end goal for the number of positions required is met. This feature allows many ranges of the Military and Law Enforcement to start their training as needed and allow the customer to plan further expansion into their yearly budget, as this is a piece of equipment.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A shooting range module comprising:

a plurality of separate and independent ballistically rated wall panels releasably coupled together to form a plurality of walls, including two planar side walls, a plurality of floor panels coupled together to form a floor, and a plurality of roof panels coupled together to form a roof, the plurality of wall panels being removably connected to the floor and the roof to define and form a space, the plurality of ballistically rated wall panels comprising at least one ballistic layer to prevent projectiles fired within the space from exiting from the space, wherein each of the ballistically rated wall panels further comprises a first structural panel support, an exterior insulation layer disposed on the first structural panel support, an exterior finish layer disposed upon the exterior insulation layer and preventing infiltration of weather elements to the insulation layer, and an interior bullet, shot, or projectile resistant layer positioned at an opposite side of the structural panel support from the exterior finish layer and exterior insulation layer;

a plurality of ballistically rated subpanels removably mounted within one or more of the plurality of wall panels, the wall panels defining openings extending therethrough having the subpanels mounted therein, each wall panel being pre-engineered to provide structural support when the corresponding subpanel is removed;

at least one shooting lane with an associated shooting position disposed within the space, the at least one shooting lane extending from a first end toward a second end of the space; and means, within the space, for collecting projectiles fired along the at least one shooting lane, the two side walls within the space extending in a planar fashion from the associated shooting position to the means for collecting projectiles and from the floor toward the roof.

2. The shooting range module as recited in claim 1, further comprising a second structural panel support disposed between the first structural panel support and the exterior insulation layer.

3. A shooting range module comprising:

a plurality of separate and independent, ballistically rated wall panels locking together to form a plurality of walls of the shooting range module, including two planar side walls, each independent, ballistically rated wall panel including a structural panel support, an exterior insulation layer disposed on the structural panel support, an exterior finish layer disposed upon the exterior insulation layer and preventing infiltration of weather elements to the insulation layer, and an interior bullet, shot, or projectile resistant layer positioned at an opposite side of the structural panel support from the exterior finish layer, a plurality of separate and independent, ballistically rated subpanels removably mounted within the wall panels, the wall panels defining openings extending therethrough each having one of the subpanels mounted therein;

a plurality of separate and independent floor panels releasably connected to the plurality of wall panels, the plurality of floor panels forming a floor of the shooting range module;

a plurality of separate and independent roof panels releasably connected to the plurality of wall panels, the plurality of roof panels forming a roof of the shooting range module, the plurality of walls, the floor and the roof defining a space within which fired projectiles are prevented from exiting from the space;

a plurality of shooting lanes defined by a portion of the wall panels within the space, each shooting lane including an associated shooting position; and means, within the space, for collecting projectiles fired along the at least one shooting lane;

wherein the two side walls within the space extend in a planar fashion from the associated shooting position to the means for collecting projectiles and a portion of the plurality of subpanels are selectively removable from corresponding wall panels such that the plurality of shooting lanes provide a training configuration for simulating at least one of urban warfare, building clearing, and tactical assaults and wherein each of the wall panels is pre-engineered to maintain structural integrity when the corresponding subpanel is removed.

4. The shooting range module as recited in claim 3, further comprising a ventilation system that can selectively heat and cool air within the space and remove contaminates and airborne particles from air within the space.

5. The shooting range module as recited in claim 3, wherein said means for collecting projectiles comprises at least one bullet trap.

6. The shooting range module as recited in claim 3, wherein each shooting position includes an overturning or removable support to support weapons fired from the shooting position.

7. The shooting range module as recited in claim 5, wherein each of the plurality of roof panels comprises at least one interior duct pre-engineered within each of the plurality of roof panels, the at least one interior duct in air communication with a ventilation system.

8. A method of installing a shooting range system, the method comprising:

receiving a plurality of separate and independent roof panels, a plurality of separate and independent wall panels, and a plurality of separate and independent floor panels, each roof panel, wall panel, and floor panel having a ballistic resistance to a projectile having a predetermined velocity, wherein the plurality of wall panels include a structural panel support, an exterior insulation layer disposed on the structural panel support, an exterior finish layer disposed upon the exterior insulation layer and preventing infiltration of weather elements to the insulation layer, and an interior bullet, shot, or projectile resistant layer positioned at an opposite side of the structural panel support from the exterior finish layer, the side walls formed from the plurality of wall panels including a plurality of ballistically rated subpanels removably mounted within the wall panels, the wall panels defining openings extending therethrough and having the subpanels mounted therein;

preparing at least one support external to the shooting range system to receive at least one of a wall panel of the plurality of wall panels and a floor panel of the plurality of floor panels;

releasably coupling each wall panel of the plurality of wall panels to one of the plurality of floor panels and each roof panel of the plurality of roof panels to at least two of the plurality of wall panels to define a space with a plurality of shooting lanes separated by a portion of the plurality of wall panels within which a weapon capable of firing the projectile can be fired, the plurality of wall panels defining two side walls within the space extending in a planar fashion from the associated shooting position to a means for collecting projectiles fired along the at least one shooting lane; and removing at least one of the plurality of subpanels to create a training configuration for simulating at least one of urban warfare, building clearing, and tactical assaults, wherein at least the plurality of wall panels provides structural integrity to the plurality of wall panels during assembly, disassembly, and transport of the shooting range system when the corresponding at least one of the plurality of subpanels is removed.

9. The method as recited in claim 8, the least one support is a pre-formed footing, a concrete pad, or the ground.

10. The method as recited in claim 8, wherein coupling each wall panel of the plurality of wall panels comprises releasably connecting each wall panel of the plurality of wall panels to the floor panel of the plurality of floor panels using at least one fastener.

11. The method as recited in claim 8, further comprising coupling adjacently positioned wall panels of the plurality of wall panels to form a wall of the shooting range system.

12. The method as recited in claim 11, further comprising positioning a protruding portion of a first wall panel of the plurality of wall panels within a receiving portion of a second wall panel adjacent to the first wall panel.

13. The method as recited in claim 11, further comprising positioning a first engaging portion of a first wall panel of the plurality of wall panels in locking engagement with a second engaging portion of a second wall panel adjacent to the first wall panel.

14. The method as recited in claim 8, further comprising mounting at least one bullet trap within a space defined by the plurality of wall panels, the plurality of floor panels, and the plurality of roof panels.

15. The method as recited in claim 8, further comprising mounting a ventilation system to the shooting range system.

16. The method as recited in claim 15, connecting one or more interior ducts to each other and to the ventilation system.

17. The method as recited in claim 8, further comprising mounting a bullet trap within a space of the shooting range system.

* * * * *